US008921023B2

(12) United States Patent
Baba et al.

(10) Patent No.: US 8,921,023 B2
(45) Date of Patent: Dec. 30, 2014

(54) MAGNETIC CARRIER AND TWO-COMPONENT DEVELOPER

(71) Applicant: Canon Kabushiki Kaisha, Tokyo (JP)

(72) Inventors: Yoshinobu Baba, Yokohama (JP); Koh Ishigami, Abiko (JP); Masayuki Hama, Toride (JP); Kentaro Kamae, Kashiwa (JP); Hiroaki Kawakami, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/961,593

(22) Filed: Aug. 7, 2013

(65) Prior Publication Data

US 2014/0045115 A1 Feb. 13, 2014

(30) Foreign Application Priority Data

Aug. 8, 2012 (JP) ..... 2012-175724

(51) Int. Cl.
*G03G 9/113* (2006.01)
*G03G 9/107* (2006.01)

(52) U.S. Cl.
CPC ..... *G03G 9/1075* (2013.01); *G03G 9/1131* (2013.01); *G03G 9/107* (2013.01)
USPC ..... 430/111.32; 430/111.33; 430/111.34; 430/111.4; 430/111.41

(58) Field of Classification Search
USPC ..... 430/111.32, 111.33, 111.34, 111.4, 430/111.41
See application file for complete search history.

(56) References Cited

U.S. PATENT DOCUMENTS

| | | | | |
|---|---|---|---|---|
| 5,108,862 | A | 4/1992 | Kishimoto et al. | |
| 8,137,886 | B2 | 3/2012 | Baba et al. | |
| 2006/0269863 | A1* | 11/2006 | Nakamura et al. | 430/111.35 |
| 2007/0048650 | A1 | 3/2007 | Inoue et al. | |
| 2012/0129087 | A1 | 5/2012 | Iwami et al. | |

FOREIGN PATENT DOCUMENTS

| | | | |
|---|---|---|---|
| EP | 0 580 135 | A1 | 1/1994 |
| EP | 2 233 980 | A1 | 9/2010 |
| JP | 2738734 | B2 | 4/1998 |
| JP | 2011-13676 | A | 1/2011 |
| WO | 2010/016605 | A1 | 2/2010 |

OTHER PUBLICATIONS

European Search Report dated Nov. 6, 2013 in European Application No. 13179519.7.

* cited by examiner

*Primary Examiner* — Hoa V Le
(74) *Attorney, Agent, or Firm* — Fitzpatrick, Cella, Harper and Scinto

(57) ABSTRACT

Provided is a magnetic carrier excellent in leakage, uniformity of a solid image having satisfactory charging stability and developing performance at low electric field. The magnetic carrier is a magnetic carrier comprising: a magnetic substance-dispersed resin carrier core, which contains a magnetic substance and a binding resin, and a coating resin on a surface thereof, wherein: the carrier core has resistivity at 1000 V/cm of $5.0\times10^{6}$-$8.0\times10^{7}$ Ω·cm, the magnetic substance has a number average particle diameter of 0.20-0.35 μm; and comprises magnetic-substance particles having vertexes and a particle diameter of 0.53 μm or more in an amount of 10.0-32.0 vol % based on a total amount of the magnetic substance; and wherein: the carrier core has $Fe_2O_3$ content of 98.00% by mass or more; and ZnO content of 0.06-0.50% by mass.

10 Claims, 5 Drawing Sheets

MAGNETIC CARRIER AND TWO-COMPONENT DEVELOPER

BACKGROUND OF THE INVENTION

1. Field of the Invention

The present invention relates to a magnetic carrier to be used in an image forming method for developing an electrostatic charge image by use of electrophotography and a two-component developer using the magnetic carrier.

2. Description of the Related Art

In a conventional electrophotographic-system image forming method generally employed, an electrostatic latent image is formed on an electrostatic latent image bearing member by use of various processes and toner is adhered to the electrostatic latent image to develop the image. In developing the image, a carrier particle called a magnetic carrier is mixed with toner to triboelectrically charge the toner. In this manner, an appropriate amount of positive or negative charge is imparted to the toner. The toner is developed by using the charge as driving force. This is a two-component development system, which has been widely used.

In the two-component development system, since a magnetic carrier can play a part in stirring, transporting and charging of a developer, the function of the magnetic carrier is clearly distinguished from that of a toner. This is advantageous since the performance of the developer can be easily controlled.

However, with technological evolution of the electrophotographic field, it has recently been more and more strenuously demanded to not only reduce the space and volume of a main body of an apparatus but also increase the operation speed and extension of life of the apparatus, as well as high definition and stable quality of image.

In the circumstances, an attempt has been made to reduce the size and the number of parts of a main-body apparatus and save energy power. Also in development, it is demanded to reduce the size of a transformer. If the strength of a development electric field is increased, a flying amount of toner and uniformity of a solid image and a half-tone image can be improved; however, adhesion and leakage of a carrier tend to occur, causing image defects. Because of this, in order to stably develop an image even in a low electric field, an attempt has been made to improve the developing performance of a magnetic carrier.

Furthermore, it is required for a developer to provide stable developing performance for a long time. To obtain long-term stability, an attempt has been made to reduce specific gravity and magnetic force of a magnetic carrier. Employing ferrite using a light element, porous ferrite and a magnetic substance-dispersed resin carrier has been proposed. A magnetic carrier prepared by filling and coating a porous magnetic ferrite with a resin and defining the strength of an electric field right before breakdown of the magnetic carrier is proposed (International Application No. WO2010/016605). As a magnetic substance-dispersed resin carrier, a magnetic substance-dispersed resin carrier obtained by direct polymerization of spherical magnetite and phenol is proposed (Japanese Patent No. 2738734).

Furthermore, with an improvement of low temperature fixation of toner, even in these carriers, adhesion or fusion (so called toner spent) of toner to a carrier surface is a matter of concern.

To deal with the problem, a magnetic carrier preventing toner spent and peel-off and wear of a coating layer, attaining long-term stability is proposed (Japanese Patent Application Laid-Open No. 2011-013676). In the carrier proposed herein, the irregularity of the carrier core surface ascribed to the shape of magnetite having a large particle diameter is controlled by varying the shape of magnetite different in size. By virtue of this, the adhesiveness of a coating layer is improved and peel-off and wear thereof are reduced, improving durability. However, if the shape of magnetite changes from a spherical shape to an irregular shape, the degree of shape anisotropy of a magnetic substance increases and residual magnetization increases. When such magnetite is used, the carrier sometimes takes the form of a chain and adheres to a region to which toner particles should be jumped and attached. This phenomenon is particularly significantly observed if the resistance of a carrier core is reduced in order to improve developing performance in a low electric field. As a result of the chain like carrier adhering to a solid image portion, the carrier serves as a spacer during transferring, reducing a transfer electric field. The toner around the carrier is not transferred, creating "fog", with the result that the solid image loses uniformity.

The mechanism of causing carrier adhesion when a low-resistant carrier core is used is conceivably as follows. Since the performance of a carrier using a low-resistant carrier core to charge a toner is low, the counter charge of the carrier is also low. When the carrier having a low counter charge is charged by developing bias applied to a development sleeve, the charge polarity of the carrier surface is reversed and charged with the same polarity as that of a toner, with the result that the carrier jumps and attaches to an image portion.

SUMMARY OF THE INVENTION

The present invention is directed to providing a magnetic carrier and two-component developer overcoming the aforementioned problems, and more specifically, to providing a magnetic carrier and two-component developer having excellent developing performance in a low-strength electric field, capable of suppressing carrier adhesion onto a solid image and capable of stably providing an image excellent in uniformity even after images are formed on many paper sheets.

According to one aspect of the present invention, there is provided a magnetic carrier comprising: a magnetic substance-dispersed resin carrier core, which contains a magnetic substance and a binding resin, and a coating resin on a surface thereof, in which: the magnetic substance-dispersed resin carrier core has a resistivity Rk at 1000 V/cm of $5.0\times10^6$ Ω·cm or more and $8.0\times10^7$ Ω·cm or less, the magnetic substance i) has a number average particle diameter of 0.20 μm or more and 0.35 μm or less, and ii) comprises magnetic-substance particles having a shape with vertexes and having a particle diameter of 0.53 μm or more in an amount of 10.0 vol % or more and 32.0 vol % or less based on a total amount of the magnetic substance; and in which: when analyzing an element in the magnetic substance-dispersed resin carrier core by a fluorescent X-ray analysis and calculating the contents of Fe element and Zn element therein by fundamental parameter quantitative method, i) an $Fe_2O_3$ content is 98.00% by mass or more, and ii) a ZnO content is 0.06% by mass or more and 0.50% by mass or less, with respect to the total amount by mass of all the detected elements provided that all the detected elements are in oxide form.

According to another aspect of the present invention, there is provided a two-component developer comprising a toner and the above-described magnetic carrier.

Use of the magnetic carrier of the present invention enables to provide a magnetic carrier and two-component developer excellent in developing performance in a low-strength electric field, capable of suppressing carrier adhesion onto a solid image and capable of stably providing an image excellent in uniformity even after images are formed on many paper sheets.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

The magnetic carrier of the present invention relates to a magnetic carrier including: a magnetic substance-dispersed resin carrier core, which contains a magnetic substance and a binding resin, and a coating resin on the surface thereof, in which: the magnetic substance-dispersed resin carrier core has a resistivity Rk at 1000 V/cm of $5.0\times10^6$ Ω·cm or more and $8.0\times10^7$ Ω·cm or less, the magnetic substance i) has a number average particle diameter of 0.20 μm or more and 0.35 μm or less; and ii) comprises magnetic-substance particles having a shape with vertexes and having a particle diameter of 0.53 μm or more in an amount of 10.0 vol % or more and 32.0 vol % or less based on the total amount of the magnetic substance; and in which: when analyzing an element in the magnetic substance-dispersed resin carrier core by a fluorescent X-ray analysis and calculating the contents of Fe element and Zn element therein by fundamental parameter quantitative method, i) an $Fe_2O_3$ content is 98.00% by mass or more, and ii) a ZnO content is 0.06% by mass or more and 0.50% by mass or less, with respect to the total amount by mass of all the detected elements provided that all the detected elements are in oxide form.

Note that, "magnetic substance-dispersed resin carrier core" will be hereinafter sometimes simply referred to as "carrier core".

A magnetic substance contained in the carrier of the present invention will be described.

Figure 5A:
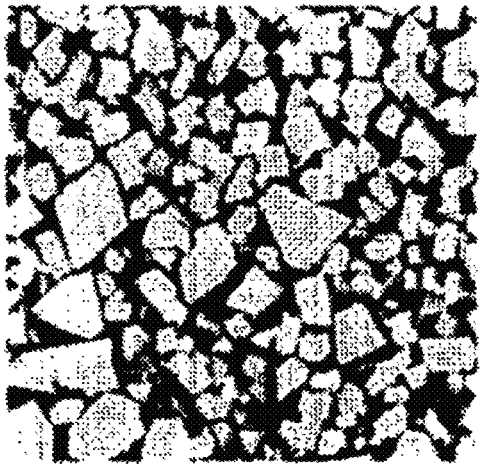
FIG. 5A is a projected sectional view of a magnetic substance having vertexes.
Figure 5B:
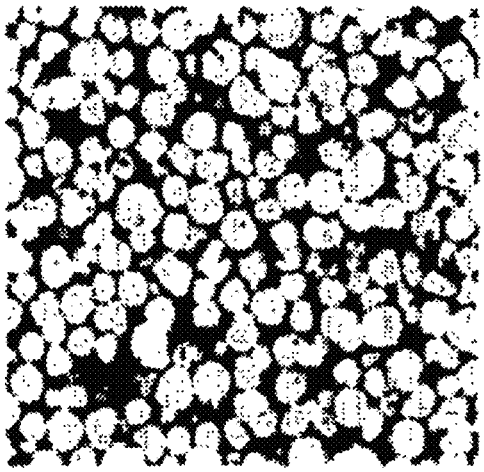
FIG. 5B is a projected sectional view of a virtually spherical magnetic substance (magnetic substance having no vertexes).

FIG. 5A and FIG. 5B illustrate sectional SEM reflection electron images of a magnetic substance having vertexes and a magnetic substance having no vertexes (virtually spherical magnetic substance). In the present invention, the magnetic substance having vertexes refers to a particle having a vertex of angle 150° or less in a section of a magnetic-substance particle observed by SEM. Favorably, the vertex has an acute angle. In other words, the vertex favorably has an angle of 90° or less. Examples of the magnetic substance include those having a shape(s) selected from a tetrahedron, a pentahedron, a hexahedron, a heptahedron, an octahedron and a mixture of these, and an irregular shape having edges different in length. In contrast, the magnetic substance having no vertexes refers to a particle having no vertexes with an angle of 150° or less in a sectional view of a magnetic-substance particle observed by SEM. Examples thereof include a polyhedral (icosahedron or more) magnetic substance and a spherical magnetic substance.

The magnetic substance according to the present invention i) has a number average particle diameter of 0.20 μm or more and 0.35 μm or less; and ii) comprises magnetic-substance particles having a shape with vertexes and having a particle diameter of 0.53 μm or more in an amount of 10.0 vol % or more and 32.0 vol % or less based on the total amount of the magnetic substance.

Since a particle having a shape with vertexes is bulky, if such particles are put together, the space between particles tends to be larger than that between particles having a shape without vertexes. Because of this, when a magnetic substance having a shape with vertexes is dispersed in a resin, the portion of resin becomes larger. Particularly, in magnetic substances having a larger size particle (particles larger than 0.53 μm), the amount of resin present between magnetic-substance particles increases. In contrast, many magnetic-substance particles of 0.20 μm or more and 0.35 μm or less easily come closer to each other and a conductive path is partly formed. More specifically, in the carrier of the present invention, sites of high resistivity and sites of low resistivity are appropriately formed within a carrier core in the microscopic sense.

Furthermore, if convex portions of a low-resistant magnetic-substance particle having a shape with vertexes are present in the surface of a carrier core, an electric field converges to acute angled portions, and therefore, the convex portions present in the surface serve as origins of internal conduction. As a result, even if a magnetic carrier coated with a resin, attenuation of counter charge present on a magnetic carrier surface after development is accelerated to improve developing performance.

Furthermore, if the number average particle diameter of magnetic-substance particles falls within the above range, the resistivity and magnetization intensity of a carrier core tend to be controlled to an appropriate level and occurrence of leakage and carrier adhesion can be suppressed. Furthermore, if the content of a magnetic-substance particle having a shape with vertexes and a particle diameter of 0.53 μm or more falls within the above range, the resistance of the carrier core is proper and counter charge can be satisfactorily attenuated.

Furthermore, in the range from the surface of a carrier core to a depth of 1.0 μm, the area proportion of the binding resin portion is favorably 35% or more and 80% or less and more favorably 45% or more and 70% or less with respect to the sum of the area of a binding resin portion and the sectional area of a magnetic substance portion.

It is necessary for the magnetic substance according to the present invention to contain zinc. Usually, magnetite has crystal anisotropy. In addition, a magnetic substance having vertexes has shape anisotropy. If zinc is incorporated into a crystal, crystal anisotropy can be relaxed. As the content of zinc, the content of ZnO is essentially 0.06% by mass or more and 0.50% by mass or less. If the content falls within the above range, the residual magnetization of the magnetic carrier can be finally set to 8.5 $Am^2/kg$ or less, and more favorably 8.0 $Am^2/kg$ or less. The FP quantitative method according to fluorescent X-ray analysis will be described later. If the content of ZnO falls within the aforementioned range, the residual magnetization of the magnetic carrier can be suppressed low while suppressing an increase of the resistivity of the carrier core. Owing to this, carrier adhesion onto a solid image can be suppressed while maintaining developing performance in a low electric field and uniformity of a solid image can be improved.

Furthermore, in the magnetic substance of the present invention, it is necessary that the content of $Fe_2O_3$ is 98.00% by mass or more. If the content is less than 98.00% by mass, magnetization amount decreases, and hence carrier adhesion may occur.

Figure 1:
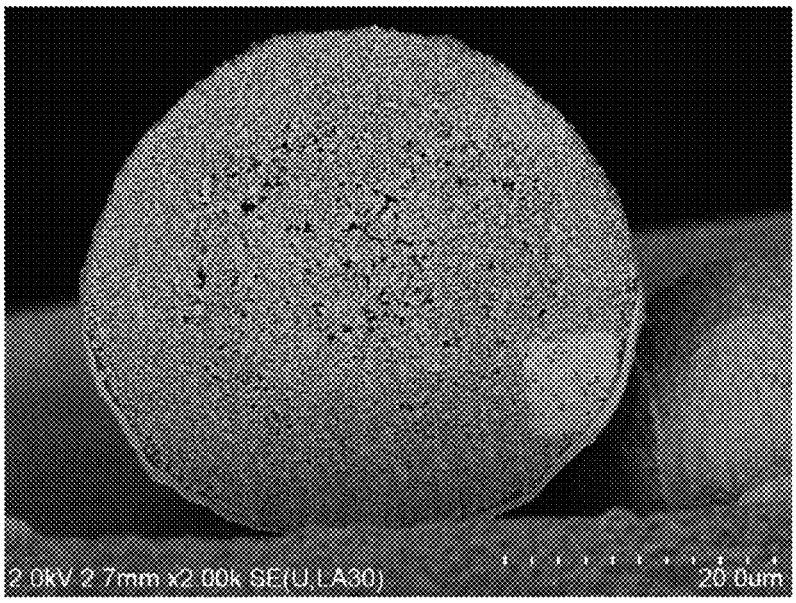
FIG. 1 is a photograph showing a projection image which is a visualized sectional reflection electron image of a magnetic substance-dispersed resin carrier core (carrier core 1) (2000×).
Figure 2:
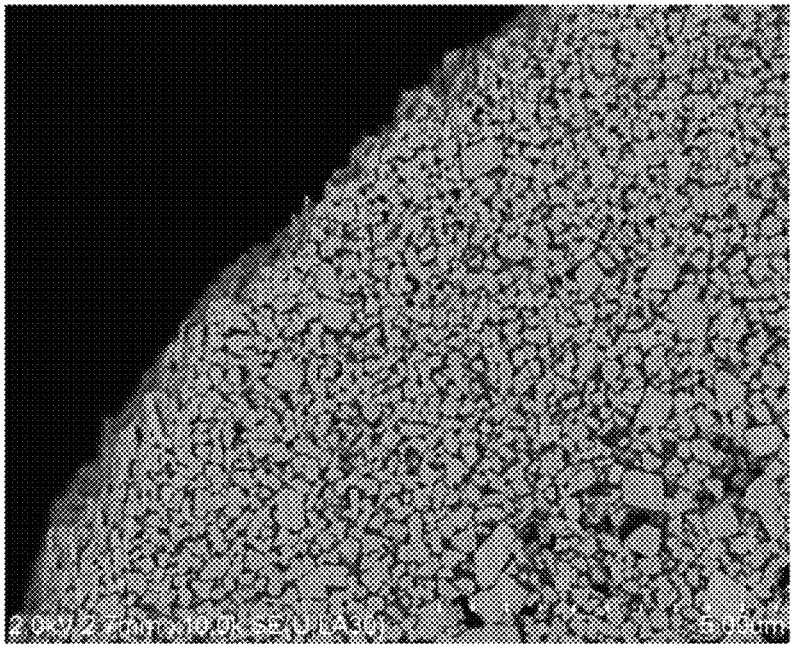
FIG. 2 is a photograph showing an enlarged projection image of the portion near the surface of the carrier core shown in FIG. 1 (10000×).

FIG. 1 shows an SEM reflection electron image of a cross section of a carrier core by FIB (2000×). An enlarged SEM reflection electron image (10000×) of the portion near the surface of the sectional view of a carrier core in FIG. 1 is shown in FIG. 2. In the sectional view of the figure, it is found that a magnetic substance mostly consists of particles having vertexes as shown in FIG. 5A. Of them, magnetic-substance particles having a large particle diameter are present at random.

Note that in producing a carrier core, if the surface property of the carrier core is controlled by using two types or more of magnetic substances different in particle diameter to make a magnetic-substance having a large particle diameter present near the surface of a carrier core, and hence developing performance in low electric-field strength can be more improved.

The magnetic substance of the present invention can be produced by a method known in the art such as a wet process and a dry process as follows. First, in a reaction vessel purged with nitrogen gas, an aqueous alkali hydroxide solution having a concentration of 2 mole/L or more and 5 mole/L or less, and an aqueous iron sulfate solution and an aqueous zinc sulfate solution having a concentration of 0.5 mole/L or more and 2.0 mole/L or less are poured to prepare a mixture solution. At this time, these solutions are added such that the molar ratio of alkali hydroxide to iron sulfate (ratio of the mole number of alkali hydroxide to the mole number of iron sulfate) becomes 1.5 or more and 5.0 or less. Furthermore, the content of zinc sulfate relative to iron sulfate is 0.15 mol % or more and 0.50 mol % or less. Subsequently, alkali hydroxide is further added so as to obtain a desired pH value. While maintaining the mixture solution at a temperature of 70° C. or more and 100° C. or less and blowing oxidizing gas (air) into the above reaction vessel, the mixture solution is stirred and mixed for 7 hours or more and 15 hours or less to produce magnetite. Furthermore, the mixture solution containing magnetite thus produced is filtered, washed with water, dried and pulverized to obtain magnetite. The viscosity of the reaction slurry can be controlled by the concentration of the aqueous iron sulfate solution to be added to the mixture solution. In this manner, the particle diameter distribution of the magnetite to be produced is controlled. Furthermore, the aqueous iron sulfate solution may contain a bivalent metal ion such as $Mn^{2+}$, $Ni^{2+}$, $Cr^{2+}$ or $Cu^{2+}$ other than $Zn^{2+}$. As the sources for the above bivalent metal ions, sulfates, chlorides and nitrates thereof are mentioned. Furthermore, $SiO_2$ may be contained if necessary. Silicate is used as a raw material thereof. If the bivalent metal ion as mentioned above is contained in the aqueous iron sulfate solution, the content thereof is favorably 0.10 mol % or more and 1.50 mol % or less relative to iron sulfate.

The shape and particle diameter distribution of magnetic-substance particles can be controlled by stirring rate, reaction temperature, pH of the reaction site, reaction time and addition of silicate. The pH value is favorably 8 or more in order to obtain magnetic-substance particles having vertexes. In order to obtain a magnetic-substance particle of an octahedron or an irregular shape, pH is favorably set at 10 or more. Furthermore, to control the magnetic property of a magnetic substance, the addition amount of zinc sulfate is favorably controlled to be 0.15 mol % or more and 0.50 mol % or less.

Magnetic-substance particles having other types of vertexes are produced by the following method. After the aforementioned magnetite particles are produced, the magnetite is granulated using polyvinyl alcohol as a binder and baked under reducing atmosphere. Thereafter, these are pulverized and classified to produce magnetic-substance particles having vertexes with controlled in particle diameter distribution. Alternatively, hematite, zinc oxide, if necessary, manganese oxide and magnesium hydroxide (desired amounts) are mixed by a ball mill. The mixture is granulated with polyvinyl alcohol as a binder and dried by a spray dryer and baked in an electric furnace at 900° C. for 10 hours. Thereafter, these are pulverized and classified to obtain magnetic-substance particles.

The resistivity of the magnetic substance at an electric-field strength of 1000 V/cm is favorably $1.0\times10^3$ Ω·cm or more and $1.0\times10^6$ Ω·cm or less.

The magnetization intensity of the magnetic substance at 79.6 kA/m (1000 oersted) is favorably 60.0 $Am^2/kg$ or more and 75.0 $Am^2/kg$ or less. Furthermore, the residual magnetization thereof after application at 79.6 kA/m is favorably 13.0 $Am^2/kg$ or less.

<Carrier Core>

Carrier core will be described.

A carrier core may be produced by either one of a knead-pulverizing process and a polymerization process as long as the carrier core where a magnetic substance is dispersed in a binder resin is obtained. The carrier core is favorably produced by a polymerization process using a thermosetting resin, i.e., a phenol resin, since the content of the magnetic substance can be increased.

Examples of the resin include a vinyl resin, a polyester resin, an epoxy resin, a phenol resin, a urea resin, a polyurethane resin, a polyimide resin, a cellulose resin, a silicone resin, an acrylic resin and a polyether resin. The resins may be used alone or as a mixture of two types or more. Particularly, a phenol resin, which can hold relatively large magnetic substance, is favorable because the strength of a carrier core can be increased. In order to increase the magnetic force of a carrier core and further to control the resistivity, the amount of the magnetic substance is increased. More specifically, in the case of a magnetite particle, the addition amount is favorably 80% by mass or more and 90% by mass or less relative to a carrier core.

An aqueous monomer, phenol and aldehyde are subjected to addition polymerization reaction performed in an aqueous medium in the presence of a basic catalyst and hardened as a phenol resol resin. At this time, a magnetic substance is added to the aqueous medium. In this manner, slurry in which the monomer and the magnetic substance are homogenized is obtained. When the resin is hardened in the course of the reaction, the magnetic substance is incorporated to produce a carrier core. If necessary, taking advantage of affinity of the aqueous medium for the surface of the magnetic substance, how the magnetic substance is present can be controlled.

When a carrier core is produced, the surface of magnetic-substance particles is favorably treated to be lipophilic in advance. The lipophilic treatment is performed with a coupling agent such as a silane coupling agent and a titanate coupling agent or by dispersing a magnetic substance in an aqueous solvent containing a surfactant.

The carrier core favorably has a 50% value on a volume distribution basis of 19.0 μm or more and 69.0 μm or less. Owing to this, 50% value of the magnetic carrier on a volume distribution basis can be set to 20.0 μm or more and 70.0 μm or less. The 50% value of the carrier core on a volume distribution basis can be controlled by controlling granulation conditions in which the stirring speed and the slurry concentration during a polymerization reaction are controlled.

It is necessary that the resistivity Rk of a carrier core at an electric-field strength of 1000 V/cm is $5.0\times10^6$ Ω·cm or more and $8.0\times10^7$ Ω·cm or less. If Rk is less than $5.0\times10^6$ Ω·cm, the carrier adhesion on a solid image and the leakage cannot be prevented. In contrast, if Rk exceeds $8.0\times10^7$ Ω·cm, developing performance decreases and a dense image cannot be formed. Rk is more favorably $1.0\times10^7$ Ω·cm to $8.0\times10^7$ Ω·cm in view of improvement of developing performance and quality of a half tone image.

As a magnetic property of a carrier core, the magnetization intensity at a magnetic field of 79.6 kA/m (1000 oersted) is favorably 50.0 $Am^2/kg$ or more and 65.0 $Am^2/kg$ or less in order to set the magnetization intensity of the magnetic carrier to 50.0 $Am^2/kg$ or more and 60.0 $Am^2/kg$ or less.

The residual magnetization of a carrier core after application of an external magnetic field of 79.6 kA/m (1000 oersted) is favorably 12.0 $Am^2/kg$ or less in order to set the residual magnetization of the magnetic carrier to 8.5 $Am^2/kg$ or less. The residual magnetization of a carrier core is more favorably set to 8.5 $Am^2/kg$ or less in order to more efficiently prevent carrier adhesion on a solid image.

The magnetic substance in a carrier core critically has an $Fe_2O_3$ content of 98.00% by mass or more and a ZnO content of 0.06% by mass or more and 0.50% by mass or less, calculated by using an FP quantitative method according to fluorescent X-ray analysis. In the FP (fundamental parameter) quantitative method, all elements detected are regarded as oxides and the total mass of all oxides is regarded as 100% by mass. Table 1 shows the results of magnetic substance 1 (magnetic substance 1 in Examples described later) measured by the FP quantitative method.

TABLE 1

| Oxide | Magnetic substance 1 (Mass %) |
|---|---|
| $Fe_2O_3$ | 99.05 |
| ZnO | 0.45 |
| MnO | 0.20 |
| $SiO_2$ | 0.19 |
| CaO | 0.05 |
| MgO | 0.03 |
| $Cr_2O_3$ | 0.02 |
| $Nd_2O_3$ | 0.00 |
| $TiO_2$ | 0.00 |
| $K_2O$ | 0.00 |
| $P_2O_5$ | 0.00 |
| Total | 100.00 |

<Resin Coating Layer>

The coating resin to be used in a coating layer is not particularly limited; however, a vinyl resin, which is a copolymer between a vinyl monomer having a cyclic hydrocarbon group in a molecular structure and another vinyl monomer, is favorable. A reduction of charge quantity under a high temperature and high humidity environment can be suppressed by coating with the vinyl resin.

Specific examples of the cyclic hydrocarbon group include cyclic hydrocarbon groups having 3 to 10 carbon atoms such as a cyclopropyl group, a cyclobutyl group, a cyclopentyl group, a cyclohexyl group, a cycloheptyl group, a cyclooctyl group, a cyclononyl group, a cyclodecyl group, an adamantyl group, a norbornyl group and an isobornyl group. Of them, a cyclohexyl group, a cyclopentyl group and an adamantyl group are favorable and a cyclohexyl group is particularly favorable in view of a stable structure, high adhesion to a carrier core, and development of release property.

Furthermore, to control glass transition temperature (Tg), another monomer may be added as a vinyl resin component.

As the other monomer to be used as a vinyl resin component, a monomer known in the art is used. Examples of the monomer are as follows: styrene, ethylene, propylene, butylene, butadiene, vinyl chloride, vinylidene chloride, vinyl acetate, methyl methacrylate, ethyl methacrylate, propyl methacrylate, vinyl methyl ether, vinyl ethyl ether and vinyl methyl ketone.

Furthermore, it is favorable that the vinyl resin to be used as a coating layer is a graft polymer since adhesion to a carrier core is improved and a uniform coating layer is formed.

A graft polymer is obtained by a method of graft polymerization performed after formation of the main chain or a copolymerization method using a macro monomer as a monomer. The copolymerization method using a macro monomer is favorable since the molecular weight of a branched chain can be controlled in advance. The number average molecular weight of a graft portion is favorably 2000 or more and 10000 or less, and more favorably, 4000 or more and 6000 or less in order to improve adhesion.

The macro monomer to be used is not particularly limited; however, a methyl methacrylate macro monomer is favorable since the charge quantity under a high temperature and high humidity environment is increased and adhesion to a carrier core is excellent.

The amount of macro monomer for use in polymerization is favorably 10 to 50 parts by mass, and more favorably, 20 to 40 parts by mass relative to 100 parts by mass of the (co) polymer of the main chain of a vinyl resin.

Furthermore, a coating resin layer may contain a particle having conductivity and a particle and material having charge controllability in addition to a coating resin. As the particle having conductivity, carbon black, magnetite, graphite, zinc oxide and tin oxide are mentioned.

The addition amount of particle and material having conductivity is favorably 0.1 part by mass or more and 10.0 parts by mass or less relative to 100 parts by mass of the coating resin in order to control the resistance of a magnetic carrier and obtain a favorable resistivity ratio of the carrier core to the magnetic carrier.

Examples of the particle and material having charge controllability include particles of organic metal complexes, particles of organic metal salts, particles of chelate compounds, particles of monoazo metal complexes, particles of acetyl acetone metal complexes, particles of hydroxycarboxylic acid metal complexes, particles of polycarboxylic acid metal complexes, particles of polyol metal complexes, particles of polymethyl methacrylate resins, a polystyrene resin particle, a melamine resin particle, a phenol resin particle, a nylon resin particle, a silica particle, a titanium oxide particle and an alumina particle.

The addition amount of particle and material having charge controllability is favorably 0.5 parts by mass or more and 50.0 parts by mass or less relative to 100 parts by mass of the coating resin in order to control triboelectric charge quantity.

The addition amount of coating resin composition containing a coating resin and other additional materials is favorably 0.1 part by mass or more and 5.0 parts by mass or less relative to 100 parts by mass of the carrier core in order to prevent leakage and improve developing performance at low electric-field strength. The addition amount thereof is more favorably 1.0 part by mass or more and 3.0 parts by mass or less.

In the surface of a magnetic carrier, convex portions of a magnetic substance having vertexes are favorably present at a density of 0.8 portions/$\mu m^2$ or more and 3.0 portions/$\mu m^2$ or less. More favorably, the density is 1.3 portions/$\mu m^2$ or more and 2.5 portions/$\mu m^2$ or less. To obtain such an exposure state of the magnetic substance, the thickness of a resin coating layer is favorably 0.1 μm or more and 1.5 μm or less.

The method for applying a coating resin composition is not particularly limited. Examples of the coating method include a soaking method, a kneading method, a spray method, a brush application method, a dry process and an application method using a fluidized bed or the like. Of them, a soaking method, a kneading method or a dry process is favorable since the angular portions of a magnetic substance having vertexes are not completely covered.

<Magnetic Carrier>

As a magnetic property of a magnetic carrier, the magnetization intensity at a magnetic field of 79.6 kA/m (1000 oersted) is favorably 50.0 $Am^2$/kg or more and 60.0 $Am^2$/kg or less, and more favorably, 55.0 $Am^2$/kg or more and 60.0 $Am^2$/kg or less. The residual magnetization is favorably 8.5 $Am^2$/kg or less in order to prevent carrier adhesion on a solid image. Particularly, in the case where the developing bias to be used is a square wave and has a low frequency, if the resistance of a carrier core is low, injection can be made more easily and the magnetic property is easily influenced by the residual magnetization.

The 50% particle diameter (D50) on a volume distribution basis is favorably 20.0 μm or more and 70.0 μm or less. This is favorable since a half tone image has a satisfactory quality and carrier adhesion on a solid image is prevented.

In the magnetic carrier of the present invention, resistivity Rc at an electric-field strength of 1000 V/cm is favorably $7.0\times10^7$ Ω·cm or more and $1.0\times10^{10}$ Ω·cm or less in order to satisfy high developing performance at a low electric-field strength and prevent an image defect such as a white spot due to high resistance.

Furthermore, resistivity Rc at an electric-field strength of 1000 V/cm is favorably $0.8\leq Rc/Rk\leq 70.0$, since the developing performance at a low electric-field strength can be improved and an image without a white spot can be stably output at the beginning and even after output of the image on many paper sheets.

The reason why an electric-field strength of 1000 V/cm is used is as follows. A magnetic carrier together with a toner is exposed to a higher electric-field strength in a development field. However, since a toner is an insulting substance, a strong electric field is predominantly applied. For the reason, the strength of the electric field applied on a magnetic carrier is presumably as low as about 1000 V/cm. Therefore, the present inventors employ the resistivity at an electric-field strength of 1000 V/cm in the resistivity measurement method.

The true specific gravity of the magnetic carrier of the present invention is favorably 3.0 g/$cm^3$ or more and 4.0 g/$cm^3$ or less in order to reduce toner spent during long time repeated use.

<Toner>

Next, a toner contained together with a magnetic carrier in a two-component developer will be described. Examples of a method for producing particles of the toner to be used in the present invention include, i) a pulverizing method in which a binding resin, a colorant and a wax are melted and kneaded, and a kneaded product is cooled, pulverized and classified, ii) a suspension granulation method in which a binding resin and a colorant are dissolved or dispersed in a solvent, the resultant solution is added to an aqueous medium to suspend and granulate, and then the solvent is removed to obtain toner particles, iii) a suspension polymerization method in which a monomer composition having a colorant and others homogeneously dissolved or dispersed in a monomer and a dispersion stabilizer are dispersed in a continuous layer (for example, a water phase) and a polymerization reaction is performed to prepare toner particles, iv) a dispersion polymerization method in which a monomer is polymerized in an aqueous organic solvent having a polymer dispersant dissolved therein to produce a particle (toner particle) insoluble in the solvent, v) an emulsion polymerization method in which direct polymerization is performed in the presence of a water soluble polar polymerization initiator to produce a toner particle, and vi) an emulsion aggregation method for obtaining toner particles including a step of aggregating at least a polymer fine particle and a colorant fine particle to form a fine particle aggregate and a step of aging the fine particles of the fine particle aggregation to fuse them.

Particularly, the toner obtained by the pulverizing method is favorable since inorganic fine particles having a large particle diameter of about 100 nm, which tend to separate after long time repeated used, are fixed by adding the inorganic fine particles to the toner after pulverizing or after pulverizing/classification and modifying the surface of the toner by a thermal treatment. Note that, if large particle diameter inorganic fine particles are fixed, the spacer effect is produced to improve transfer performance.

As the shape of a toner, it is favorable that an average circularity is 0.945 or more and 0.985 or less in view of developing performance, transfer performance and cleaning performance. Further favorably, an average circularity is 0.960 or more and 0.980 or less, because a cleaner-less system can be realized, with the result that the size of a main body apparatus can be reduced.

Examples of the binder resin to be contained in a toner are as follows: polyester, polystyrene; polymers of styrene derivatives such as poly-p-chlorostyrene and polyvinyl toluene; styrene copolymers such as a styrene-p-chlorostyrene copolymer, a styrene-vinyl toluene copolymer, a styrene-vinyl naphthalene copolymer, a styrene-acrylate copolymer, a styrene-methacrylate copolymer, a styrene-methyl α-chloromethacrylate copolymer, a styrene-acrylonitrile copolymer, a styrene-vinyl methyl ketone copolymer, a styrene-butadiene copolymer, a styrene-isoprene copolymer and a styrene-acrylonitrile-indene copolymer; polyvinyl chloride, a phenol resin, a modified phenol resin, a maleic resin, an acrylic resin, a methacrylic resin, polyvinyl acetate resin, a silicone resin; a polyester resin having a monomer selected from an aliphatic polyhydric alcohol, an aliphatic dicarboxylic acid, an aromatic dicarboxylic acid, an aromatic dialcohol and a diphenol, as a structural unit; a polyurethane resin, a polyamide resin, polyvinyl butyral, a terpene resin, a cumarone indene resin, a petroleum resin and a hybrid resin having a polyester unit and a vinyl polymer unit.

In the binding resin, it is favorable that the peak molecular weight (Mp) in a molecular weight distribution is 2,000 or more and 50,000 or less; a number average molecular weight (Mn) is 1,500 or more and 30,000 or less; a weight average molecular weight (Mw) is 2,000 or more and 1,000,000 or less; and a glass transition point (Tg) is 40° C. or more and 80° C. or less, which are measured by a gel permeation chromatography (GPC), in order to maintain balance between storage stability and low temperature fixation of a toner.

It is favorable to use wax in an amount of 0.5 parts by mass or more and 20.0 parts by mass or less per 100 parts by mass of a binding resin since an image having high glossiness can be provided. Furthermore, the peak temperature of a maximum endothermic peak of a wax is favorably 45° C. or more and 140° C. or less. This is favorable since balance between the storage stability of a toner and hot offset resistance can be maintained.

Examples of a wax are as follows: hydrocarbon waxes such as a low molecular weight polyethylene, a low molecular weight polypropylene, an alkylene copolymer, a microcrystalline wax, a paraffin wax and Fischer-Tropsch wax; oxides of a hydrocarbon wax such as an oxidized polyethylene wax or a block copolymer thereof; waxes containing an fatty acid ester such as carnauba wax, behenic acid behenyl ester wax and montanic acid ester wax, as a main component; and wholly or partially deoxidized fatty acid esters such as deoxidized carnauba wax. Of them, a hydrocarbon wax such as Fischer-Tropsch wax is favorable since an image having high glossiness can be provided.

As the colorant to be contained in a toner, the following ones are mentioned.

Examples of a black colorant include carbon black and a magnetic substance. A black colorant may be prepared from a yellow colorant, a magenta colorant and a cyan colorant.

Examples of the magenta colorant include a condensed azo compound, a diketo-pyrrolo-pyrrole compound, anthraquinone, quinacridone compound, a basic dye lake compound, a naphthol compound, a benzimidazolone compound, a thioindigo compound and a perylene compound.

Examples of the cyan colorant include C. I. Pigment blue 1, 2, 3, 7, 15:2, 15:3, 15:4, 16, 17, 60, 62, 66; C. I. vat blue 6, C. I., acid blue 45 and a copper phthalocyanine pigment having a phthalocyanine skeleton with 1 to 5 phthalimide methyl substituents.

Examples of the yellow colorant include a condensed azo compound, an isoindolinone compound, an anthraquinone compound, an azo metal compound, a methine compound and an allylamide compound.

As a colorant, a pigment may be used alone; however, it is more favorable that a dye and a pigment are used in combination to improve the definition of the color in view of the quality of full color image.

The use amount of colorant, except the case where a magnetic substance is used, is favorably 0.1 part by mass or more and 30.0 parts by mass or less relative to 100 parts by mass of the binding resin and more favorably 0.5 parts by mass or more and 20.0 parts by mass or less.

To a toner, if necessary, a charge controlling agent can be added. As the charge controlling agent to be added to a toner, those known in the art can be used; however it is particularly favorable to use a metal compound of aromatic carboxylic acid, which is colorless and allows toner to be charged at a high speed and can stably maintain a predetermined charge quantity.

A charge controlling agent may be internally added or externally added to a toner particle. The addition amount of charge controlling agent is favorably 0.2 parts by mass or more and 10.0 parts by mass or less relative to 100 parts by mass of the binding resin.

It is favorable that additives are externally added to a toner in order to improve flowability. As the additive to be externally added, inorganic fine particles such as silica, titanium oxide and aluminum oxide are favorable. The inorganic fine particles are favorably hydrophobized with a hydrophobizing agent such as a silane compound, silicone oil or a mixture of these. The additive to be externally added is favorably used in an amount of 0.1 part by mass or more and 5.0 parts by mass or less relative to 100 parts by mass of the toner particles. Toner particles and the additive to be externally added can be mixed with a mixer known in the art such as a Henschel mixer.

A two-component developer is favorably prepared by adding a toner to a magnetic carrier in a ratio of 2 parts by mass or more and 15 parts by mass or less relative to 100 parts by mass of the magnetic carrier, and more favorably, 4 parts by mass or more and 12 parts by mass or less. If the ratio falls within the above range, scattering of toner can be reduced and triboelectric charge quantity can be stabilized for a long time.

Furthermore, if the two-component developer is used as a supplemental developer, the mixing ratio of a toner relative to a magnetic carrier is favorably 2 parts by mass or more and 50 parts by mass or less relative to 1 part by mass of the magnetic carrier and more favorably 4 parts by mass or more and 20 parts by mass or less. If the mixing ratio falls within the above range, the triboelectric charge quantity can be stably obtained, and further advantageously, the frequency of exchanging a supplemental developer, which is burden to the user, can be reduced.

A supplemental developer is prepared by weighing desired amounts of magnetic carrier and toner and mixing these by a mixer. Examples of the mixer include a double con-mixer, a V-shape mixer, a drum mixer, a super mixer, a Henschel mixer and a Nauta mixer. Of them, a V-shape mixer is favorable in view of dispersiveness of a magnetic carrier.

How to measure physical properties according to the present invention will be described below.

<Resistivity of Magnetic Carrier, Carrier Core and Magnetic Substance>

Figure 4A:
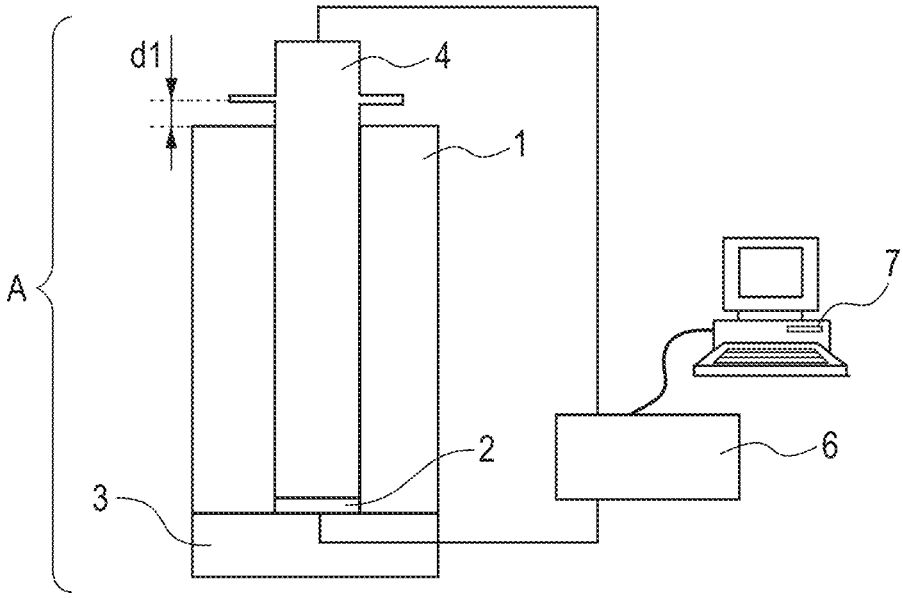
FIG. 4A is a schematic view of an apparatus for measuring the resistivity of a magnetic substance, magnetic substance-dispersed resin carrier core and magnetic carrier used in the present invention.
Figure 4B:
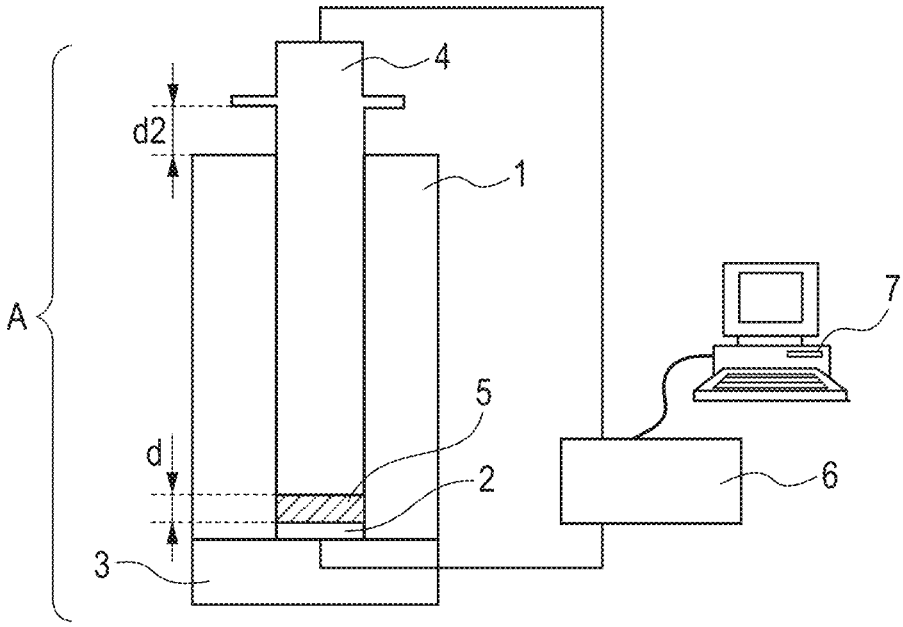
FIG. 4B is a schematic view of an apparatus for measuring the resistivity of a magnetic substance, magnetic substance-dispersed resin carrier core and magnetic carrier used in the present invention.

Resistivity of a magnetic carrier and a carrier core is measured by the measurement apparatus schematically shown in FIG. 4A and FIG. 4B.

Note that, resistivity of a carrier core is measured by using a sample before resin coating. Alternatively, the coating layer of a coated magnetic carrier is dissolved with chloroform and the resultant magnetic carrier is dried and then put in use. When resistivity of the magnetic carrier after long-time repeatedly used is measured, the magnetic carrier to be subjected to the measurement is prepared as follows. In order to measure the resistivity of a magnetic carrier which is taken out from a two-component developer repeatedly used for long time, the two-component developer is put in a plastic container containing water and a surfactant, and the container is spun to remove toner from the magnetic carrier. Then, a magnet is attached to the bottom of the plastic container to hold the magnetic carrier at the bottom of the container and the toner is washed away. Rinsing with water is further repeatedly performed to remove toner until the color of the toner disappears from the discharging water. Thereafter, the magnetic carrier is put in a dryer (40° C.) and dried for 24 hours to obtain the magnetic carrier after long-time repeated use.

In either case of the samples, measurement is performed after a sample is allowed to stand still in the environment of a temperature of 23° C. and a humidity of 50% RH for 24 hours.

Resistance measurement cell A is constituted of a perforated cylindrical PTFE resin container 1 having a sectional area of 2.4 $cm^2$, a lower electrode (made of stainless steel) 2, a support base (made of a PTFE resin) 3 and an upper electrode (made of stainless steel) 4. The cylindrical PTFE resin container 1 is mounted on the support base 3, and filled with about 0.7 g of a sample 5 (magnetic carrier, carrier core, or magnetic substance). On the sample 5 filled, the upper electrode 4 is placed to measure the thickness of the sample. When the initial thickness (no sample is placed) previously measured is represented by d1 (blank), the true thickness of the sample (about 0.7 g) filled is represented by d, and the thickness of the sample measured is represented by d2 (sample), the true thickness d of the sample is expressed by the following equation.

$$d = d2\ (\text{sample}) - d1\ (\text{blank})$$

The resistivity of a magnetic carrier, a carrier core and a magnetic substance can be obtained by applying a voltage between the electrodes and measuring a current flowing at that time. The resistivity is measured by an electrometer 6 (Keithley 6517 manufactured by Keithley Instruments) and a control computer 7.

Measurement conditions are follows: contact area S of a sample (magnetic carrier, carrier core and magnetic substance) with an electrode is set at 2.4 $cm^2$, and load on the upper electrode is set at 230 g.

Application conditions of voltage are as follows. An IEEE-488 interface is used for controlling between the control computer and the electrometer. Using automatic range function of the electrometer, screening is performed by applying voltages of 1V, 2V, 4V, 8V, 16V, 32V, 64V, 128V, 256V, 512V and 1000V independently for one second. At this time, whether voltage application can be made up to a maximum 1000 V (for example, electric-field strength is 10000 V/cm in the case of a sample 1.00 mm in thickness,) is determined by the electrometer. If overcurrent flows, a lamp of "VOLTAGE SOURCE OPERATE" blinks. If so, the application voltage is reduced and applicable voltage is further screened. In this manner, a maximum application voltage is automatically determined. Thereafter, actual measurement is performed. A voltage, which is obtained by dividing maximum voltage value by 5, is applied and maintained for 30 seconds in each step and thereafter a current value is measured to determine a resistance value. More specifically, if a maximum application voltage is 1000 V, a voltage is applied stepwise at the intervals of 200 V, which is ⅕ of the maximum application voltage, in the ascending order like 200 V (first step), 400 V (second step), 600 V (third step), 800 V (fourth step) and 1000 V (fifth step) and then in descending order like 1000 V (sixth step), 800 V (seventh step), 600 V (eighth step), 400 V (ninth step) and 200 V (tenth step). The voltage is maintained for 30 seconds in each step and then the current value is measured to determine the resistance value.

The resistance values are processed by the computer to calculate electric-field strength and resistivity and then plotted to obtain a graph. Resistivity at an electric-field strength of 1000 V/cm is read out from the graph.

Note that, resistivity and electric-field strength are obtained from the following equation.

$$\text{Resistivity } (\Omega\cdot\text{cm}) = (\text{application voltage (V)}/\text{measured current (A)}) \times S\ (\text{cm}^2)/d\ (\text{cm})$$

$$\text{Electric-field strength (V/cm)} = \text{application voltage (V)}/d\ (\text{cm})$$

<Measurement Method of Contents of $Fe_2O_3$ and ZnO Contained in Magnetic Substance and Carrier Core>

The contents of $Fe_2O_3$ and ZnO in a carrier core are measured by using a sample before resin coating. Alternatively, the coating layer of a coated magnetic carrier is dissolved with chloroform and the resultant magnetic carrier is dried and then put in use.

Elements from Na to U contained in a carrier core are directly measured under a He atmosphere by using a wavelength dispersion type fluorescent X-ray analyzer Axios advanced (manufactured by Spectris Co., Ltd.).

A cup for a liquid sample provided in the apparatus is used to attach a PP (polypropylene) film to the bottom therein and put a sufficient amount (10 g) of a sample therein to form a uniform layer on the bottom. After the cup is covered with a lid, measurement is performed at a power of 2.4 kW.

A FP (fundamental parameter) method is used for analysis. At this time, all elements detected are assumed to be oxides and the total mass of the oxides is regarded as 100% by mass. The contents (% by mass) of $Fe_2O_3$ and ZnO are obtained as the oxide equivalent values relative to the total mass by use of software UniQuant 5 (ver.5.49) (manufactured by Spectris Co., Ltd.).

<Method for Determining 50% Particle Diameter (D50) on a Volume Distribution Basis of Magnetic Carrier and Carrier Core>

A particle diameter distribution is determined by laser diffraction/scattering system particle diameter distribution measurement apparatus "Microtrack MT3300EX" (manufactured by Nikkiso Co., Ltd.).

Determination of 50% particle diameter (D50) on a volume distribution basis of a magnetic carrier and a carrier core is made by attaching a sample supplier for a dry process measurement "one shot dry sample conditioner Turbotrac" (manufactured by Nikkiso Co., Ltd). Supply conditions by Turbotrac are as follows: a dust collector is used as a vacuum source (air capacity: about 33 liters/sec, pressure: about 17 kPa). Control is automatically performed through software. As the particle diameter, a 50% particle diameter (D50), which is a cumulative value on a volume distribution basis, is obtained. Control and analysis are made by use of the accompanying software (version 10.3.3-202D). Measurement conditions are as follows.

Set Zero time: 10 seconds
Measurement time: 10 seconds
Measurement times: Once
Particle refractive index: 1.81
Particle shape: Spherical
Upper limit of measurement: 1408 μm
Lower limit of measurement: 0.243 μm
Measurement environment: 23° C./50% RH <Method for Determining Number Average Particle Diameter and the Content of Particles Having a Diameter of 0.53 μm or More in a Particle Diameter Distribution on a Volume Basis of Magnetic Substance>

The particle diameter distribution of a magnetic substance is determined by use of a magnetic substance before a carrier core is produced. When the distribution is determined from a magnetic carrier, a coating resin composition is removed with chloroform from the magnetic carrier and the resultant carrier core is put on an alumina boat, baked in a muffle furnace at 600° C. for one hour and minced in an agate mortar. The particles thus obtained are measured.

A magnetic substance is observed by a scanning electron microscope (SEM), S-4800 (manufactured by Hitachi High-Technologies Corporation) under the following conditions.

SignalName=SE (U, LA80)
AcceleratingVoltage=2000 Volt
EmissionCurrent=11000 nA
WorkingDistance=8000 um
LensMode=High
CondenSer1=5000
ScanSpeed=Capture Slow (20)
Magnification=30000 (used for measurements)
DataSize=1280×960
ColorMode=Grayscale
SpecimenBias=0V Note that, a reflection electron image is obtained as a 256-gradation gray scale image under the above conditions by controlling contrast to be 5 and brightness to be −5 on the control software of a scanning electron microscope S-4800 and turning off a magnetic substance observation mode.

Subsequently, the obtained image is printed out on an A3 paper sheet as an enlarged image. The horizontal Feret diameter and the shape of the magnetic substance are measured. The horizontal Feret diameter measured is converted into an actual length (diameter) with reference to the scale on the picture. The particle diameters thus measured are classified into 16 columns: (0.016 μm-0.023 μm), (0.023 μm-0.033 μm), (0.033 μm-0.047 μm), (0.047 μm-0.066 μm), (0.066 μm-0.094 μm), (0.094 μm-0.133 μm), (0.133 μm-0.187 μm), (0.187 μm-0.265 μm), (0.265 μm-0.375 μm), (0.375 μm-0.530 μm), (0.530 μm-0.750 μm), (0.750 μm-1.060 μm), (1.060 μm-1.499 μm), (1.499 μm-2.121 μm), (2.121 μm-2.999 μm), (2.999 μm-4.241 μm), to obtain a particle diameter distribution. As a number average particle diameter, an arithmetic average particle diameter is used. Furthermore, if a particle diameter distribution on a volume basis is obtained, a volume distribution is obtained by assuming spheres having the same diameters as the horizontal Feret diameters.

The shape of a magnetic substance is measured by separately counting the numbers of particles having no vertexes (formed by two edges) having an angle of 150° or less and the numbers of particles having a vertex (formed by two edges) having an angle of 150° or less, on the picture. More specifically, magnetic-substance particles having a horizontal Feret diameter of 0.1 μm or more are targeted. The angle formed by virtually linear lines (0.05 μm or more) is measured by a protractor.

The cumulative value of "magnetic substances having vertexes" present in column (0.530 μm-0.750 μm) and columns of larger particle diameters is divided by the cumulative value of total particles to obtain the content of the "magnetic substances having vertexes" of 0.530 μm or more. A particle diameter distribution is obtained by measuring 300 particles arbitrarily chosen.

More specifically, when a number average particle diameter is calculated, all particles are classified into the above columns and a medium value of each column (representative particle diameter) is obtained and multiplied by a relative amount of particles (delta %) and then divided by the total of relative amounts of particles (100%).

First, the particle diameter range (a maximum particle diameter: $x_1$, a minimum particle diameter: $x_{n+1}$) to be measured is divided by n. Individual particle diameter zones are designated as $[x_j, x_{j+1}]$ (j=1, 2, . . . , n). In this case, division is made equally on the logarithmic scale. Furthermore, based on the logarithmic scale, the representative particle diameter per particle diameter zone is expressed by the following expression.

$$\frac{\log_{10}x_j + \log_{10}x_{j+1}}{2} \quad \text{Expression 1}$$

Furthermore, assuming that $r_j$ (j=1, 2, . . . , n) is defined as a relative amount of particles (delta %) corresponding to a particle diameter zone $[x_j, x_{j+1}]$ and the total of all zones is regarded as 100%, an average value μ on the logarithmic scale can be calculated in accordance with the following expression.

$$\mu = \frac{1}{100}\sum_{j=1}^{n} r_j\left(\frac{\log_{10}x_j + \log_{10}x_{j+1}}{2}\right) \quad \text{Expression 2}$$

The symbol μ represents a numerical value on the logarithmic scale and has no unit as a particle diameter. Thus, to convert μ into a unit of a particle diameter, $10^{\mu}$, that is, 10 to the μth power is calculated. The value of $10^{\mu}$ is regarded as a number average particle diameter.

Furthermore, distribution expressed on a number basis can be converted to distribution expressed on a volume basis, by calculating delta % (volume basis) from delta % (number basis) in accordance with the following expression. The obtained delta % (volume basis) is applied to the column and the cumulative value of "magnetic substances having vertexes" present in a column (0.530 μm-0.750 μm) and columns of larger particle diameters is divided by the cumulative value of total particles to obtain the content of the "magnetic substances having vertexes" with a diameter of 0.530 μm or more.

$$y_j = \frac{\log_{10}x_j + \log_{10}x_{j+1}}{2} \quad \text{Expression 3}$$

$$z_j = 10^{y_j}$$

$$p_j = r_j \cdot (z_j)^3$$

$$s = \sum_{j=1}^{m} p_j$$

$$q_j = \frac{p_j}{s} \times 100$$

The division number of particle diameter: m
Particle diameter (j=1, 2, . . . m+1)
Average particle diameter per zone (j=1, 2, . . . m)
Delta % (number basis): $r_j$ (j=1, 2, . . . m)
Delta % (volume basis): $q_j$ (j=1, 2, . . . m)

<Method for Measuring True Specific Gravity of Magnetic Carrier>

The true specific gravity of the magnetic carrier according to the present invention is determined by using a dry process automatic densitometer autopicnometer (manufactured by Yuasa Ionics Inc.).

Cell: SM cell (10 mL)
Amount of sample: 2.0 g

In the method, the true density of a solid or liquid substance is measured based on a gas phase substitution method based on the Archimedes' principle similarly to a liquid phase substitution method. Since He gas is used as substitution medium, the measurement precision of a magnetic carrier using a carrier core is high.

<Method for Measuring Magnetization Intensity and Residual Magnetization of Magnetic Carrier, Carrier Core and Magnetic Substance>

The magnetization intensity of a magnetic carrier can be obtained by an oscillating field magnetic property measurement apparatus (Vibrating sample magnetometer) or a direct current magnetic characteristic recording apparatus (B-H tracer). In the present invention, measurement is made by use of an oscillating field magnetic property measurement apparatus BHV-30 (manufactured by Riken Denshi Co., Ltd.) in the following procedure.

The magnetizing moment at an external magnetic field of 79.6 kA/m (1000 oersted) is measured by use of a cylindrical plastic container sufficiently densely filled with a magnetic carrier as a sample. In measurement, a maximum positive external magnetic field (+79.6 kA/m) is applied and thereafter a maximum negative external magnetic field (−79.6 kA/m) is applied to make a hysteresis loop. The average of absolute values of positive and negative maximum values is obtained and defined as a maximum magnetizing moment (emu); whereas the average of absolute values of the positive and negative magnetizing moments when the intensity of the external magnetic field becomes 0 is obtained and defined as residual magnetization moment (emu). In addition, the actual mass (g) of the magnetic carrier filling in the container is measured. The magnetizing moment is divided by mass to obtain the magnetization intensity ($Am^2/kg$) and residual magnetization ($Am^2/kg$) of the magnetic carrier. The magnetization intensity and residual magnetization of each of a carrier core and a magnetic substance are obtained in the same manner.

<Method for Calculating the Area Ratio of a Binder Resin Portion to a Magnetic Substance Portion in a Section from the Surface of a Carrier Core to a Depth of 1.0 μm>

A carrier core can be sectioned by use of a focused ion beam process observation apparatus (FIB), FB-2100 (manufactured by Hitachi High-Technologies Corporation). The carrier core used herein is prepared by previously treating a magnetic carrier with chloroform to remove a coating layer.

A sample is prepared by applying carbon paste onto side surfaces of end portions of a cutout mesh for FIB, adhering a small amount of carrier core particles thereto so as to be discretely present from each other and depositing platinum thereon to form a conductive film. The carrier core to be sectioned is selected at random from particles having a size falling within the range of ±10% of the 50% particle diameter (D50) on a volume distribution basis.

Note that, a sample is sectioned such that the section finally obtained has virtually a maximum diameter in a sectioning direction. To describe more specifically, assuming that the distance between a position in a flat surface including a maximum length of a particle in the direction parallel to the adhesion surface of the sample and the adhesion surface is specified as h. (For example, in the case of a complete spherical shape having a radius r, h=r) a sample is sectioned in the direction perpendicular to the adhesion surface within the range of h±10% distance (for example, in the case of a complete spherical shape having a radius r, the range is the distance of r±10% from the adhesion surface).

A sample is sectioned at an acceleration voltage of 40 kV, by use of a Ga ion source at a beam current of 39 nA (for rough cutting) and at a beam current of 7 nA (for finish cutting).

The sample section can be directly observed by a scanning electron microscope (SEM). In the observation by the scanning electron microscope, the emission amount of reflection electrons varies depending on the atomic numbers of substances constituting the sample. Thus, an image showing the composition of the carrier core section can be obtained. In the observation of the carrier core section, a region of a heavy element derived from a magnetic substance, for example, a magnetite component, looks bright (looks white since brightness is high); whereas a region of a light element derived from a resin component or a void looks dark (looks black since brightness is low). The site to be measured is a site near "carrier core surface" to which beam is not applied firstly during the FIB process.

More specifically, observation conditions by a scanning electron microscope (SEM), S-4800 (manufactured by Hitachi High-Technologies Corporation) are as follows.

SignalName=SE (U, LA30)
AcceleratingVoltage=2000 Volt
EmissionCurrent=10000 nA
WorkingDistance=8000 um
LensMode=High
CondenSer1=12
ScanSpeed=40 sec
Magnification=10000 (used for measurements)
DataSize=1280×960
ColorMode=Grayscale
SpecimenBias=0V A reflection electron image is obtained as a 256-gradation gray scale image under the above conditions by controlling contrast to be 5 and brightness to be −5 on the control software of a scanning electron microscope S-4800 and turning off a magnetic substance observation mode.

At a site on the obtained image at a distance of 1.0 μm inward from the surface of the carrier core, a trace line of the carrier core surface is drawn. Of the regions partitioned by the trace line, in the region near the surface, the ratio of the area of binder resin portions to the area of magnetic-substance particle portions is obtained. This processing may be performed by use of an image processing software or by use of an image printed out on a paper sheet.

More specifically, the process can be carried out by the following method.

On the gray scale image mentioned above, a trace line is drawn by use of PowerPoint (manufactured by Microsoft). The image is printed out on an A3 paper sheet. A tracing paper sheet is superposed on the image printed out and an outline and the trace line are transferred, and further, the portions of magnetic-substance particles are completely filled with black.

Next, the outer boundary, the magnetic-substance particles and a binder resin region (not filled with black) on the tracing paper sheet are captured by a camera. The image thus captured is analyzed by use of image analysis software Image-ProPlus (manufactured by MediaCybernetics, ver 5. 1. 1. 32) to computationally obtain the ratio of the total area of the binder resin to the total area of magnetic substances.

The ratio of binder-resin area (area %)=(outer boundary area−sum of magnetic-substance areas)/outer boundary area×100

This operation is repeated with respect to 10 carrier core particles and average of the area ratio (area %) of the binder resin near the carrier core surface is computationally obtained.

<Method for Counting the Number of Convex Portions of Magnetic Substances in the Magnetic Carrier Surface>

The convex portions of magnetic substances in the magnetic carrier surface are counted under observation by a scanning electron microscope (SEM). In the observation by the scanning electron microscope, the emission amount of reflection electrons varies depending on the atomic numbers of substances constituting the sample. Thus, an image showing the composition of the magnetic carrier can be obtained. In the observation of the surface of a magnetic carrier, a region of a heavy element derived from a magnetic substance, for example, a magnetite component, looks bright (looks white since brightness is high); whereas a region of a light element derived from a resin component looks dark (looks black since brightness is low). Furthermore, in the case where the surface is formed of a resin and a magnetic substance is present inside the surface, an intermediate color density (gray) between black and white is shown. In measuring, the center of the viewing field is controlled to meet with the head of a magnetic carrier.

More specifically, a magnetic carrier is observed by a scanning electron microscope (SEM), S-4800 (manufactured by Hitachi High-Technologies Corporation) under the following conditions.

SignalName=SE (U, LA30)
AcceleratingVoltage=2000 Volt
EmissionCurrent=10000 nA
WorkingDistance=8000 um
LensMode=High
CondenSer1=12
ScanSpeed=40 sec
Magnification=10000 (used for measurements)
DataSize=1280×960
ColorMode=Grayscale
SpecimenBias=0V Note that, a reflection electron image is obtained as a 256-gradation gray scale image under the above conditions by controlling contrast to be 5 and brightness to be −5 on the control software of a scanning electron microscope S-4800 and turning off a magnetic substance observation mode.

In the obtained image, "regions (white portion) of a heavy element derived from a magnetite component" present in a 5-μm square are counted and divided by 25. This is the number of convex portions (portions/$\mu m^2$) of a magnetic substance in the magnetic-carrier surface. In this case, as regions of a heavy element derived from a magnetite component (white portion), regions having a maximum diameter of 0.2 μm or more (white portion) are counted. This measurement is performed by selecting 10 particles at random from the particles having a size falling within the range of ±10% of the 50% particle diameter (D50) on a volume distribution basis.

<Method of Determining Weight Average Particle Diameter (D4) and Number Average Particle Diameter (D1) of Toner>

The weight average particle diameter (D4) and number average particle diameter (D1) of toner are calculated as follows. As a measurement apparatus, an accurate particle diameter distribution measurement apparatus "Coulter counter Multisizer 3" (registered trade mark, manufactured by Beckman•Coulter) equipped with a 100 μm-aperture tube based on a pore electrical resistance method is used. For setting measurement conditions and analyzing measurement data, the accompanying special software "Beckman•Coulter Multisizer 3 Version3.51" (manufactured by Beckman•Coulter) is used. Note that, measurement is performed by using effective 25000 measuring channels.

The aqueous electrolyte solution for use in measurement is prepared by dissolving special grade sodium chloride in ion exchanged water up to a concentration of about 1% by mass. For example, "ISOTON II" (manufactured by Beckman•Coulter) can be used.

Note that, before measurement and analysis, the special software is set as follows.

In the setting screen of "change standard operation method (SOM)" of the special software, the total count number in control mode is set at 50,000 particles, measurement times is set at 1, Kd value is set at the value obtained by using "standard particle 10.0 μm" (manufactured by Beckman•Coulter). A "threshold/noise level measuring button" is pressed to automatically set the threshold and the noise level. Furthermore, "current" is set at 1600 μA, "gain" is set at 2, and "electrolyte" is set at ISOTON II. "Flush aperture tube after measurement" is checked.

In the setting screen of "change pulse to particle diameter" of the special software, "bin interval" is set at logarithmic particle diameter, "particle-diameter bin" is set at 256 particle diameter bin, and "particle diameter range" is set at 2 μm to 60 μm.

Specific determination methods of a weight average particle diameter (D4) and a number average particle diameter (D1) are as follows.

(1) In a 250 mL round-bottom glass beaker for exclusive use of Multisizer 3, the aqueous electrolyte solution (about 200 mL) mentioned above is poured. The beaker is set on a sample stand. A stirrer rod is rotated counterclockwise at a rate of 24 rotations/second. Subsequently, stain and air bubbles within an aperture tube are removed by use of "flush of aperture" function of the special software.

(2) In a 100 mL flat-bottom glass beaker, the aqueous electrolyte solution (about 30 mL) is poured. To this, serving as a dispersant, about 0.3 mL of a diluted solution of "Contaminon N" (10 mass % aqueous solution of a neutral detergent consisting of a nonionic surfactant, an anionic surfactant, an organic builder, pH7, for cleaning a precision measuring apparatus, manufactured by Wako Pure Chemical Industries Ltd.) with ion exchanged water up to about 3 folds by mass is added.

(3) An ultrasonic disperser, "Ultrasonic Dispension System Tetora 150" (manufactured by Nikkaki Bios Co., Ltd) having an electric power of 120 W and having two oscillators with an oscillating frequency of 50 kHz (phases are shifted by 180°) is prepared. In a water vessel of the ultrasonic disperser, about 3.3 L of ion exchanged water is poured. To the water vessel, Contaminon N (about 2 mL) is added.

(4) The beaker prepared in (2) is set at a beaker standing hole of the ultrasonic disperser and then the ultrasonic disperser is actuated. Subsequently, the height of installation position of the beaker is controlled such that the resonance state of the liquid surface of the aqueous electrolyte solution in the beaker becomes a maximum.

(5) While applying ultrasonic wave to the aqueous electrolyte solution in the beaker set in (4), a toner (about 10 mg) is added in small portions to the aqueous electrolyte solution and dispersed. Subsequently, the ultrasonic dispersion treatment is continued for a further 60 seconds. Note that, in dispersion with ultrasonic wave, the temperature of water in the water vessel is appropriately controlled so as to fall within the range of 10° C. or more and 40° C. or less.

(6) To the round-bottom beaker prepared in (1) placed on a sample stand, the aqueous electrolyte solution prepared in (5) having a toner dispersed therein is added dropwise by a pipette to control the measurement concentration to be about 5%. Measurement is continued until the number of particles measured reaches 50,000.

(7) Measurement data is analyzed by the accompanying special software to calculate a weight average particle diameter (D4) and a number average particle diameter (D1). Note that, when graph/vol % is set in the special software, "average diameter" displayed in the screen of "analysis/volume statistical value (arithmetic average)" is the weight average particle diameter (D4). When graph/number % is set in the special software, "average diameter" displayed in the screen of an "analysis/number statistical value (arithmetic average)" is the number average particle diameter (D1).

<Method for Measuring of Average Circularity of Toner>

The average circularity of a toner is measured by a flow-system particle image analyzer "FPIA-3000" (manufactured by Sysmex Corporation) under the same measurement and analysis conditions as those for calibration work.

The measurement principle of the flow-system particle image analyzer "FPIA-3000" (manufactured by Sysmex Corporation) is that flowing particles are imaged as a static image and analyzed. The sample fed to a sample chamber is suctioned by a syringe and fed to a flat sheath flow cell. The sample fed to the flat sheath flow cell is sandwiched by the sheath liquid to form a flat flow. To the sample passing through the flat sheath flow cell, strobe light is applied at intervals of 1/60 seconds and thus flowing particles can be imaged as a static image. Furthermore, since the flow is flat, a focused image can be taken. A particle image is taken by a CCD camera and the image taken is processed at 512×512 image processing resolution (0.37 μm×0.37 μm per pixel). Outline extraction of each particle image is performed to measure e.g., the projected area S, peripheral length L of the particle image.

Next, the circle-equivalent diameter and circularity are obtained by using the area S and peripheral length L obtained above. The circle-equivalent diameter refers to the diameter of a circle having the same area as the projected area of a particle image. The circularity is defined as a value obtained by dividing the peripheral length of a circle obtained from a circle-equivalent diameter by the peripheral length of a particle projection image and calculated in accordance with the following expression.

$$\text{Circularity}=2\times(\pi\times S)^{1/2}/L$$

When a particle image is a circle, the circularity is 1. As the degree of irregularity of outer periphery of a particle image increases, the circularity decreases. After the circularity of each of the particles is calculated, the range of circularity from 0.200 to 1.000 is divided by 800 and the arithmetic average of the obtained values of circularity is calculated. The average value is defined as an average circularity.

The measurement method is specifically as follows. First, in a glass container, ion exchanged water (about 20 mL), from which e.g., solid impurities are previously removed, is poured. To the solution, serving as a dispersant, about 0.2 mL of a diluted solution of "Contaminon N" (10 mass % aqueous solution of a neutral detergent consisting of a nonionic surfactant, an anionic surfactant, an organic builder, pH 7, for cleaning a precision measuring apparatus, manufactured by Wako Pure Chemical Industries Ltd.) with ion exchanged water up to about 3 folds by mass is added. Furthermore, a measurement sample (about 0.02 g) is added. The mixture solution is dispersed by use of an ultrasonic disperser for 2 minutes to prepare a dispersion solution for measurement. At this time, the dispersion solution is appropriately cooled such that the temperature of the dispersion solution becomes 10° C. or more and 40° C. or less. As the ultrasonic disperser, a desktop type ultrasonic cleaner disperser having an oscillating frequency of 50 kHz and an electric power of 150 W (for example "VS-150" (manufactured by VELVO-CLEAR)) is used. A predetermined amount of ion exchanged water is poured in a water vessel. To the water vessel, Contaminon N (about 2 mL) is added.

Measurement is performed by use of a flow-system particle image analyzer as mentioned above having a regular objective lens (10×) installed therein. As a sheath liquid, a particle sheath "PSE-900A" (manufactured by Sysmex Corporation) is used. The dispersion solution prepared in accordance with the aforementioned procedure is fed to the flow-system particle image analyzer. Toner particles (3000 particles) are measured in HPF measuring mode (total count mode). In analyzing particles, the binarization threshold is set at 85% and the particles to be analyzed is limited to those having a circle-equivalent diameter of 1.985 μm or more and less than 39.69 μm and the average circularity of toner particles is obtained.

In measurement, before initiation of measurement, automatic focus control is performed by use of the standard latex particle (for example, "RESEARCH AND TEST PARTICLES Latex Microsphere Suspensions 5200A" (manufactured by Duke Scientific, diluted with ion exchanged water). Thereafter, it is favorable that focus is controlled every 2 hours from initiation of measurement.

Note that, in Examples, a flow-system particle image analyzer is used, which accompanies a calibration certificate issued by Sysmex Corporation. The certificate certifies that a calibration operation is performed by Sysmex Corporation. Measurement is performed under the same measurement and analysis conditions as in calibration work (based on which calibration certificate is issued) except that the analysis particle diameter is limited to a circle-equivalent diameter of 1.985 μm or more and less than 39.69 μm.

<Method for Distinguishing Magnetic Substance Having Vertexes from Magnetic Substance Having No Vertexes>

As a method for distinguishing a magnetic substance having vertexes from a magnetic substance having no vertexes, a section of a magnetic carrier can be directly observed by a scanning electron microscope (SEM) to distinguish the magnetic substances.

More specifically, the magnetic carrier to be used in the present invention can be sectioned by a focused ion beam observation apparatus (FIB), FB-2100 (manufactured by Hitachi High-Technologies Corporation).

A sample is prepared by applying carbon paste onto side surfaces of end portions of a cutout mesh for FIB, adhering a small amount of magnetic carrier thereto so as to be discretely present from each other and depositing platinum thereon to form a conductive film. The magnetic carrier to be sectioned is selected at random from particles having a size within the range of ±10% of the 50% particle diameter (D50) on a volume distribution basis.

A sample is sectioned at an acceleration voltage of 40 kV, by use of a Ga ion source at a beam current of 39 nA (for rough cutting) and at a beam current of 7 nA (for finish cutting).

The sample section can be directly observed by a scanning electron microscope (SEM). In the observation by the scanning electron microscope, the emission amount of reflection electrons varies depending on the atomic numbers of substances constituting the sample. Thus, an image showing the composition of the magnetic substance-dispersed resin core section can be obtained. In the observation of the magnetic substance-dispersed resin core section, a region of a heavy element derived from a magnetic substance, for example, a magnetite component, looks bright (looks white since brightness is high); whereas a region of a light element derived from a resin component or a void looks dark (looks black since brightness is low).

More specifically, observation conditions by a scanning electron microscope (SEM), S-4800 (manufactured by Hitachi High-Technologies Corporation) are as follows.

SignalName=SE (U, LA30)
AcceleratingVoltage=2000 Volt
EmissionCurrent=10000 nA

WorkingDistance=8000 um
LensMode=High
CondenSer1=12
ScanSpeed=40 sec
Magnification=30000 (used for measurements)
DataSize=1280×960
ColorMode=Grayscale
SpecimenBias=0V Note that, a reflection electron image is obtained as a 256-gradation gray scale image under the above conditions by controlling contrast to be 5 and brightness to be −5 on the control software of a scanning electron microscope S-4800 and turning off a magnetic substance observation mode.

Under observation by a scanning electron microscope (SEM) under the above conditions, particles having no vertexes of an angle of 150° or less and particles having vertexes of an angle of 150° or less are separately counted. Using an image magnified to 30000×, magnetic-substance particles having a maximum diameter of 0.1 μm or more in a section are measured.

In an image magnified to 30000×, the angle formed by virtually linear lines (0.05 μm or more) is obtained.

EXAMPLES

Next, the present invention will be more specifically described below by way of Production Examples and Examples, which will not be construed as limiting the present invention.

Preparation of Magnetic Substance 1

While nitrogen gas is supplied at a rate of 20 L/minute to a reaction vessel equipped with a gas injection pipe, an aqueous ferrous sulfate solution (50 L) containing $Fe^{2+}$ (2.0 mole/L), an aqueous zinc sulfate solution (0.5 L) containing $Zn^{2+}$ (1.0 mole/L), an aqueous sodium silicate (No. 3) solution (1.0 L) containing $Si^{4+}$ (0.2 mole/L) and an aqueous manganese sulfate solution (1.0 L) containing $Mn^{2+}$ (0.2 mole/L) are mixed. Subsequently, to the obtained mixture solution, a 5 mole/L aqueous sodium hydroxide solution (40 L) is added to control pH to be 11 and the temperature is increased to 90° C. Stirring is continued and air is supplied in place of nitrogen gas at a rate of 100 L/minute for 30 minutes. The mixture solution is neutralized to pH 7 with diluted sulfuric acid. The generated particles are washed with water, filtered, dried and pulverized to obtain magnetite. The type and amount of starting material and pH are variously changed to obtain magnetic substance 1 shown in Table 2.

Magnetic substance 1 (irregular-shape magnetite, number average particle diameter: 0.21 μm) (100 parts by mass) and a silane coupling agent (3-glycidoxypropyltrimethoxysilane) (1.0 part by mass) are fed to a container. Subsequently, the mixture is stirred in the container at 100° C. for one hour at a high speed to treat the surface of magnetic substance 1.

Preparation of Magnetic Substances 2 to 5, 8 and 9

Magnetic substances 2 to 5, 8 and 9 are obtained in the same synthesis manner as in magnetic substance 1 except that the conditions are changed to the conditions shown in Table 1. Thereafter, the surfaces of the particles are treated in the same manner as in magnetic substance 1.

Preparation of Magnetic Substance 6

$Fe_2O_3$ (99.30 parts by mass), ZnO (0.15 parts by mass), $Mn_3O_4$ (0.15 parts by mass) and $MgCO_3$ (0.40 parts by mass) are mixed and stirred in a wet-process ball mill for hours and pulverized. Polyvinyl alcohol (1 part by mass) is added, granulated, dried by a spray dryer and baked in an electric furnace under a nitrogen atmosphere of an oxygen concentration of 0.0 vol % at 900° C. for 10 hours.

The obtained magnetic substance is pulverized in a dry-process ball mill for 5 hours. Fine particles and rough particles are simultaneously classified and removed by a wind classifier (Elbow-jet, LABO EJ-L3, manufactured by Nittetsu Mining Co., Ltd.) to obtain magnetic substance 6. The surface treatment shown in Table 2 is performed in the same manner as in magnetic substance 1.

Preparation of Magnetic Substances 7 and 10

Magnetic substances 7 and 10 are also obtained in the same manner as in magnetic substance 6 except that the starting material is appropriately changed and pulverized and classification conditions are changed, and then a surface treatment is performed in the same manner as in magnetic substance 6.

TABLE 2

| | Type | Shape | Process | Component content (mass %) | | Number average particle diameter | Content of magnetic substance having vertexes with a diameter of 0.53 μm or more on a volume basis | Resistivity |
|---|---|---|---|---|---|---|---|---|
| | | | | $Fe_2O_3$ | ZnO | (μm) | (volume %) | (Ω · cm) |
| Magnetic substance 1 | Magnetite | Irregular shape | Synthesis | 99.05 | 0.45 | 0.21 | 0.3 | $7.3 \times 10^5$ |
| Magnetic substance 2 | Magnetite | Irregular shape | Synthesis | 99.06 | 0.46 | 0.67 | 96.7 | $7.0 \times 10^5$ |
| Magnetic substance 3 | Magnetite | Spherical shape | Synthesis | 99.12 | 0.30 | 0.22 | 0.0 | $2.1 \times 10^5$ |
| Magnetic substance 4 | Magnetite | Octahedron | Synthesis | 99.03 | 0.17 | 0.28 | 0.7 | $5.2 \times 10^5$ |
| Magnetic substance 5 | Magnetite | Irregular shape | Synthesis | 99.15 | 0.30 | 0.62 | 86.7 | $6.4 \times 10^5$ |
| Magnetic substance 6 | Magnetite | Irregular shape | pulverizing | 99.19 | 0.11 | 0.34 | 15.0 | $6.7 \times 10^5$ |
| Magnetic substance 7 | Magnetite | Irregular shape | pulverizing | 99.18 | 0.07 | 0.35 | 18.0 | $6.4 \times 10^5$ |
| Magnetic substance 8 | Magnetite | Spherical shape | Synthesis | 99.09 | 0.00 | 0.23 | 0.0 | $4.1 \times 10^5$ |
| Magnetic substance 9 | Magnetite | Octahedron | Synthesis | 99.13 | 0.00 | 0.67 | 92.0 | $6.2 \times 10^5$ |
| Magnetic | Magnetite | Irregular | pulverizing | 99.11 | 0.30 | 0.40 | 20.3 | $7.0 \times 10^5$ |

TABLE 2-continued

| substance 10 | shape | | | | |
|---|---|---|---|---|---|
| | | | | Lipophilic treatment | |
| | | Magnetization intensity ($Am^2/kg$) | Residual magnetization ($Am^2/kg$) | Type | Amount (parts by mass) |
| | Magnetic substance 1 | 65.0 | 4.4 | 3-Glycidoxypropyltrimethoxysilane | 1.0 |
| | Magnetic substance 2 | 65.7 | 4.3 | 3-Glycidoxypropyltrimethoxysilane | 0.7 |
| | Magnetic substance 3 | 66.1 | 4.0 | 3-Glycidoxypropyltrimethoxysilane | 1.0 |
| | Magnetic substance 4 | 66.0 | 7.7 | 3-Glycidoxypropyltrimethoxysilane | 1.0 |
| | Magnetic substance 5 | 65.5 | 6.8 | 3-Glycidoxypropyltrimethoxysilane | 0.7 |
| | Magnetic substance 6 | 64.8 | 8.4 | 3-Glycidoxypropyltrimethoxysilane | 0.7 |
| | Magnetic substance 7 | 63.5 | 9.3 | 3-Glycidoxypropyltrimethoxysilane | 0.7 |
| | Magnetic substance 8 | 65.8 | 8.7 | 3-Glycidoxypropyltrimethoxysilane | 1.0 |
| | Magnetic substance 9 | 63.4 | 12.3 | 3-Glycidoxypropyltrimethoxysilane | 0.7 |
| | Magnetic substance 10 | 62.5 | 6.3 | 3-Glycidoxypropyltrimethoxysilane | 0.7 |

As a result of observation of sections of magnetic-substance particles by a SEM, it was confirmed that magnetic substances 3 and 8 are magnetic substances having no vertexes (virtually spherical magnetic substances); whereas, magnetic substances 1, 2, 4 to 7, 9 and 10 are magnetic substances having vertexes. Note that, magnetic substances 1, 2, 5 to 7 and 10 had vertexes of an acute angle.

Preparation of Magnetic Substance-Dispersed Resin Carrier Core 1

| | |
|---|---|
| Phenol | 10.0 parts by mass |
| Formaldehyde solution (37% by mass aqueous formaldehyde solution) | 15.0 parts by mass |
| Surface treated magnetic substance 1 | 70.0 parts by mass |
| Surface treated magnetic substance 2 | 30.0 parts by mass |
| 25% by mass ammonia water | 3.5 parts by mass |
| Water | 15.0 parts by mass |

The materials mentioned above are placed in a reaction batch and mixed well at a temperature of 40° C. Thereafter, the mixture is heated to a temperature of 85° C. at an average temperature increase rate of 1.5° C./minute while stirring, held at a temperature of 85° C. and subjected to a polymerization reaction for 3 hours to harden the mixture. The circumferential speed of a stirring vane at this time is set at 1.96 m/second.

After the polymerization reaction, the resultant is cooled to a temperature of 30° C. and water is added. The supernatant solution is removed and the obtained precipitate is washed with water and dried in the air. The obtained air-dried product is dried under reduced pressure (5 hPa or less) at a temperature of 60° C. to obtain magnetic substance-dispersed resin carrier core 1 having a magnetic substance dispersed therein and having an average particle diameter of 36.4 μm.

The true specific gravity of magnetic substance-dispersed resin carrier core 1 is 3.56 $g/cm^3$ and the resistivity at 1000 V/cm is $5.6\times10^7$ Ω·cm. The magnetization intensity at 79.6 kA/m is 57.4 $Am^2/kg$ and the residual magnetization at this time is 3.8 $Am^2/kg$. The contents of $Fe_2O_3$ and ZnO obtained by the FP quantitative method are 99.05% by mass and 0.45% by mass, respectively. The SEM reflection electron image of a section of carrier core 1 is shown in FIG. 2.

Preparation of Magnetic Substance-Dispersed Resin Carrier Cores 2 to 9

Figure 3:
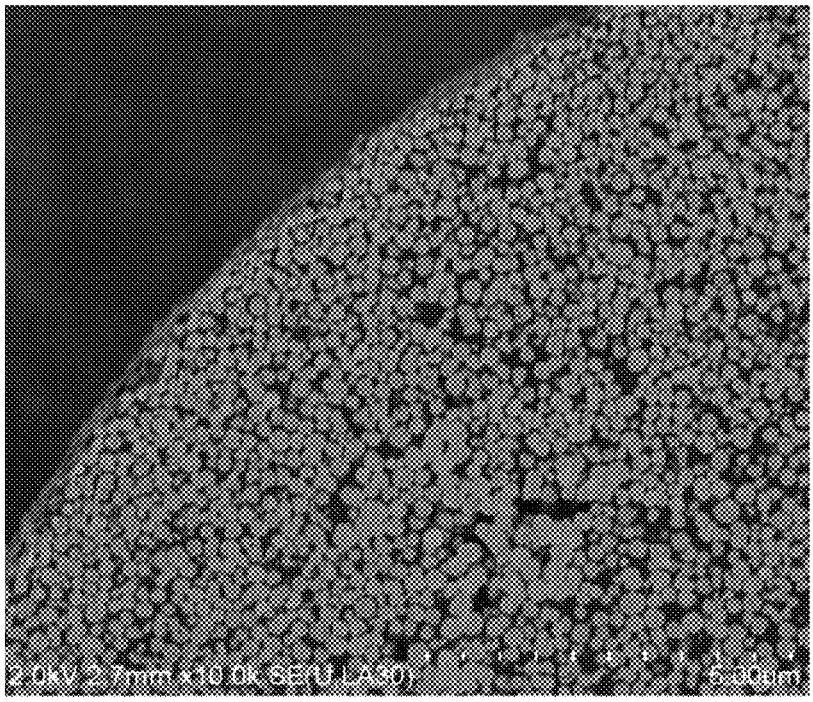
FIG. 3 is a photograph showing a projection image which is visualized and enlarged sectional reflection electron image of the portion near the surface of a magnetic substance-dispersed resin carrier core (carrier core 6) according to a Comparative Example (10000×).

Magnetic substance-dispersed resin carrier cores 2 to 9 are obtained in the same manner as in magnetic substance-dispersed resin carrier core 1 except that the conditions are changed to those shown in Table 3. The resultant physical properties are shown in Table 4. FIG. 3 shows an SEM reflection electron image of a section of carrier core 6.

TABLE 3

| | Magnetic substance 1 | | Magnetic substance 2 | | Phenols | | Aldehyde | | Basic catalyst | | Water Amount |
|---|---|---|---|---|---|---|---|---|---|---|---|
| | Type | Amount (parts by mass) | Type | Amount (parts by mass) | Type | Amount (parts by mass) | Type | Amount (parts by mass) | Type | Amount (parts by mass) | (parts by mass) |
| Carrier core 1 | Magnetic substance 1 | 70.0 | Magnetic substance 2 | 30.0 | Phenol | 10.0 | Formaldehyde (37% aqueous solution) | 15.0 | Ammonia (25% aqueous solution) | 3.5 | 15.0 |
| Carrier core 2 | Magnetic substance 3 | 70.0 | Magnetic substance 2 | 30.0 | Phenol | 10.0 | Formaldehyde (37% aqueous solution) | 15.0 | Ammonia (25% aqueous solution) | 3.5 | 15.0 |

TABLE 3-continued

| | Magnetic substance 1 | | Magnetic substance 2 | | Phenols | | Aldehyde | | Basic catalyst | | Water Amount |
|---|---|---|---|---|---|---|---|---|---|---|---|
| | Type | Amount (parts by mass) | Type | Amount (parts by mass) | Type | Amount (parts by mass) | Type | Amount (parts by mass) | Type | Amount (parts by mass) | (parts by mass) |
| Carrier core 3 | Magnetic substance 4 | 80.0 | Magnetic substance 5 | 20.0 | Phenol | 10.0 | Formaldehyde (37% aqueous solution) | 15.0 | Ammonia (25% aqueous solution) | 3.5 | 15.0 |
| Carrier core 4 | Magnetic substance 6 | 100.0 | — | — | Phenol | 10.0 | Formaldehyde (37% aqueous solution) | 15.0 | Ammonia (25% aqueous solution) | 3.5 | 15.0 |
| Carrier core 5 | Magnetic substance 7 | 100.0 | — | — | Phenol | 10.0 | Formaldehyde (37% aqueous solution) | 15.0 | Ammonia (25% aqueous solution) | 3.5 | 15.0 |
| Carrier core 6 | Magnetic substance 3 | 100.0 | — | — | Phenol | 10.0 | Formaldehyde (37% aqueous solution) | 15.0 | Ammonia (25% aqueous solution) | 3.5 | 15.0 |
| Carrier core 7 | Magnetic substance 1 | 100.0 | — | — | Phenol | 10.0 | Formaldehyde (37% aqueous solution) | 15.0 | Ammonia (25% aqueous solution) | 3.5 | 15.0 |
| Carrier core 8 | Magnetic substance 8 | 70.0 | Magnetic substance 9 | 30.0 | Phenol | 10.0 | Formaldehyde (37% aqueous solution) | 15.0 | Ammonia (25% aqueous solution) | 3.5 | 15.0 |
| Carrier core 9 | Magnetic substance 10 | 100.0 | — | — | Phenol | 13.0 | Formaldehyde (37% aqueous solution) | 19.5 | Ammonia (25% aqueous solution) | 4.5 | 20.0 |

TABLE 4

| | 50% Particle diameter (μm) | Number average particle diameter of magnetic substance (μm) | Content of magnetic substance having vertexes with a diameter of 0.53 μm or more on a volume basis (volume %) | Content of binder resin on core surface (area %) | True specific gravity (g/cm$^3$) | Resistivity (Ω · cm) |
|---|---|---|---|---|---|---|
| Carrier core 1 | 36.4 | 0.24 | 28.0 | 47 | 3.56 | $5.6 \times 10^7$ |
| Carrier core 2 | 36.2 | 0.25 | 27.3 | 60 | 3.55 | $3.2 \times 10^7$ |
| Carrier core 3 | 35.9 | 0.29 | 17.3 | 42 | 3.54 | $7.5 \times 10^6$ |
| Carrier core 4 | 36.3 | 0.34 | 15.0 | 37 | 3.55 | $4.3 \times 10^7$ |
| Carrier core 5 | 36.5 | 0.35 | 16.7 | 35 | 3.56 | $9.2 \times 10^6$ |
| Carrier core 6 | 36.0 | 0.22 | 0.0 | 26 | 3.54 | $2.1 \times 10^8$ |
| Carrier core 7 | 36.2 | 0.21 | 0.3 | 30 | 3.53 | $7.5 \times 10^6$ |
| Carrier core 8 | 35.8 | 0.26 | 27.6 | 33 | 3.55 | $1.0 \times 10^7$ |
| Carrier core 9 | 36.2 | 0.40 | 20.0 | 32 | 3.45 | $9.3 \times 10^8$ |

Preparation of Coating Resin Solution 1

A methyl methacrylate macromer (an average value n=50) having an ethylenic unsaturated group at one of the ends and having a weight average molecular weight of 5,000 (28 parts by mass), a cyclohexyl methacrylate monomer (70 parts by mass) having cyclohexyl as a unit and having an ester site and a methyl methacrylate monomer (2 parts by mass) are fed to a four-neck flask equipped with a reflux condenser, a thermometer, a nitrogen injection pipe and a rubbing stirrer. Furthermore, toluene (90 parts by mass), methyl ethyl ketone (110 parts by mass) and azobisisovaleronitrile (2.0 parts by mass) are added. The obtained mixture is maintained at 70° C. for 10 hours under nitrogen flow to obtain a solution of resin 1 (solid substance: 33% by mass). This solution was analyzed by gel permeation chromatography (GPC) to obtain a weight average molecular weight of 55,000. Furthermore, Tg is 94° C.

To a solution (30 parts by mass) of resin 1 obtained above, crosslinked melamine particles (a maximum-peak particle diameter on a number distribution basis: 0.2 μm) (0.5 parts by mass), carbon black fine particle (a maximum-peak particle diameter on a number distribution basis: 0.04 μm, resistivity: $9.0 \times 10^{-1}$ Ω·cm) (0.5 parts by mass) and toluene (70 parts by mass) are added. Subsequently, the mixture is more sufficiently stirred by a homogenizer to obtain coating resin solution 1 (coating-resin solid substance: 10% by mass).

Preparation of Coating Resin Solution 2

To the solution of resin 1 (solid substance: 33% by mass) (30 parts by mass) obtained in the step of preparing coating resin solution 1, toluene (70 parts by mass) is added. The mixture is stirred well to obtain coating resin solution 2 (coating-resin solid substance: 10% by mass).

Preparation of Coating Resin Solution 3

A cyclohexyl methacrylate monomer (70 parts by mass) having a cyclohexyl as a unit and having an ester site, a methyl methacrylate monomer (30 parts by mass) are subjected to synthesis in the same manner as in resin 1 to obtain a solution of resin 2 (solid substance: 33% by mass). The weight average molecular weight is 57,800. Furthermore, Tg is 93° C. Coating resin solution 3 is obtained in the same manner as in coating resin solution 1 in accordance with the formulation shown in Table 4.

Production of Magnetic Carrier 1

Carrier core 1 (100 parts by mass) is fed to a nauta mixer (VN type manufactured by Hosokawa Micron Group) and stirred while rotating by setting the revolution of a screw type stirring vane at 3.5 rotations per minute and auto-rotation at 100 rotations per minute, and supplying nitrogen at a flow rate of 0.1 $m^3$/min to reduce pressure (about 0.01 MPa). Furthermore, the mixture is heated to a temperature of 70° C. Coating resin solution 1 (total amount: 12 parts by mass) is added dropwise. The addition amount is divided into three portions (4 parts by mass for each), which are added at intervals of 20 minutes. After the entire amount is added dropwise, the mixture is continuously stirred for 30 minutes in order to remove the solvent. After cooling, a magnetic carrier is taken out. The coating amount relative to the carrier core (100 parts by mass) is 1.2 parts by mass. The magnetic carrier is transferred to a mixer having a rotatable mixing container equipped with a spiral vane (drum mixer UD-AT type, manufactured by Sugiyama Heavy Industrial) and treated with heat at a temperature of 100° C. for 2 hours under a nitrogen atmosphere. After cooling, the mixture is passed through a sieve having a mesh size of 75 μm to produce magnetic carrier 1. The physical properties of the obtained magnetic carrier are shown in Table 5.

Production of Magnetic Carriers 2 to 11

Magnetic carriers 2 to 11 are obtained in the same manner as in magnetic carrier 1 except that the formulation of a resin solution is changed as shown in Table 4. The physical properties of the obtained magnetic carriers are shown in Table 5.

TABLE 5

| | Core Type/amount (parts by mass) | Coating layer: Resin solution | Coating layer: Resin/Amount (parts by mass) | Coating layer: Conductive agent/amount (parts by mass) | Coating layer: Charge controlling particle/amount (parts by mass) | 50% particle diameter (μm) |
|---|---|---|---|---|---|---|
| Magnetic carrier 1 | Core 1/100 | 1 | Resin 1/1.2 | Carbon black/0.06 | Melamine/0.06 | 36.6 |
| Magnetic carrier 2 | Core 2/100 | 1 | Resin 1/1.2 | Carbon black/0.06 | Melamine/0.06 | 36.4 |
| Magnetic carrier 3 | Core 1/100 | 2 | Resin 1/0.3 | — | — | 36.4 |
| Magnetic carrier 4 | Core 1/100 | 3 | Resin 2/1.5 | Carbon black/0.05 | Melamine/0.10 | 36.8 |
| Magnetic carrier 5 | Core 3/100 | 1 | Resin 1/1.2 | Carbon black/0.06 | Melamine/0.06 | 36.1 |
| Magnetic carrier 6 | Core 4/100 | 1 | Resin 1/1.2 | Carbon black/0.06 | Melamine/0.06 | 36.5 |
| Magnetic carrier 7 | Core 5/100 | 1 | Resin 1/1.2 | Carbon black/0.06 | Melamine/0.06 | 36.6 |
| Magnetic carrier 8 | Core 6/100 | 1 | Resin 1/1.2 | Carbon black/0.06 | Melamine/0.06 | 36.3 |
| Magnetic carrier 9 | Core 7/100 | 1 | Resin 1/1.2 | Carbon black/0.06 | Melamine/0.06 | 36.5 |
| Magnetic carrier 10 | Core 8/100 | 1 | Resin 1/1.2 | Carbon black/0.06 | Melamine/0.06 | 36.0 |
| Magnetic carrier 11 | Core 9/100 | 1 | Resin 1/1.2 | Carbon black/0.06 | Melamine/0.06 | 36.5 |

| | Number of convex portions of magnetic substance (portions/$\mu m^2$) | True specific gravity (g/$cm^3$) | Resistivity Rc (Ω · cm) | Rc/Rk | Magnetization intensity ($Am^2$/kg) | Residual magnetization ($Am^2$/kg) |
|---|---|---|---|---|---|---|
| Magnetic carrier 1 | 2.1 | 3.55 | $1.1 \times 10^8$ | 2.0 | 56.9 | 3.7 |
| Magnetic carrier 2 | 1.8 | 3.53 | $2.0 \times 10^8$ | 6.3 | 57.7 | 3.6 |
| Magnetic carrier 3 | 2.9 | 3.56 | $4.0 \times 10^7$ | 0.7 | 57.3 | 3.8 |
| Magnetic carrier 4 | 1.5 | 3.53 | $4.0 \times 10^9$ | 71.4 | 56.8 | 3.6 |
| Magnetic carrier 5 | 2.4 | 3.53 | $3.1 \times 10^8$ | 41.3 | 57.8 | 6.5 |
| Magnetic carrier 6 | 2.5 | 3.54 | $6.3 \times 10^8$ | 14.7 | 56.7 | 7.3 |
| Magnetic carrier 7 | 2.7 | 3.54 | $1.6 \times 10^8$ | 17.4 | 55.6 | 8.1 |
| Magnetic carrier 8 | 0.9 | 3.52 | $1.2 \times 10^{11}$ | 571.4 | 57.8 | 3.4 |
| Magnetic carrier 9 | 0.8 | 3.52 | $5.0 \times 10^8$ | 98.0 | 56.8 | 3.8 |
| Magnetic carrier 10 | 0.6 | 3.54 | $4.5 \times 10^8$ | 45.0 | 56.9 | 8.6 |
| Magnetic carrier 11 | 1.2 | 3.44 | $6.0 \times 10^{10}$ | 64.5 | 52.6 | 5.3 |

Production Example of Polyester Resin 1

| | |
|---|---|
| Terephthalic acid: | 299 parts by mass |
| Trimellitic anhydride: | 19 parts by mass |
| Polyoxypropylene(2.2)-2,2-bis(4-hydroxyphenyl)propane: | 747 parts by mass |
| Titanium dihydroxybis(triethanolaminate): | 1 part by mass |

The materials mentioned above are weighed and placed in a reaction vessel equipped with a condenser pipe, a stirrer and a nitrogen inlet pipe. Thereafter, the mixture is heated to a temperature of 200° C. and nitrogen is fed to the reaction vessel. A reaction is carried out for 10 hours while removing generating water. Thereafter, the pressure is reduced to 1.3 kPa and a reaction is performed for one hour to obtain polyester resin 1 having a weight average molecular weight (Mw) of 6,100.

Production Example of Polyester Resin 2

| | |
|---|---|
| Terephthalic acid: | 332 parts by mass |
| Polyoxyethylene(2.2)-2,2-bis(4-hydroxyphenyl) propane: | 996 parts by mass |
| Titanium dihydroxybis(triethanolaminate): | 1 part by mass |

The materials mentioned above are weighed and placed in a reaction vessel equipped with a condenser pipe, a stirrer and a nitrogen inlet pipe. Thereafter, the mixture is heated to a temperature of 220° C. and nitrogen is fed to the reaction vessel. A reaction is carried out for hours while removing generating water. Furthermore, trimellitic anhydride (96 parts by mass) is added. The mixture is heated to a temperature of 180° C. and a reaction is performed for 2 hours to obtain polyester resin 2 having a weight average molecular weight (Mw) of 83,000.

Production Example of Toner 1

| | |
|---|---|
| Polyester resin 1: | 80 parts by mass |
| Polyester resin 2: | 20 parts by mass |
| Paraffin wax (melting point: 75° C.): | 7 parts by mass |
| Cyan pigment (C.I. Pigment Blue 15:3): | 7 parts by mass |
| Aluminum 3,5-di-t-butylsalicylate compound: | 1 part by mass |

The materials mentioned above are mixed well by a Henschel mixer (FM-75 type, manufactured by Nippon Coke Engineering Co., Ltd.) and kneaded by a double-shaft kneader (PCM-30 type, manufactured by IKEGAI) set at a temperature of 130° C. The kneaded product obtained is cooled, roughly pulverized by a hummer mill into particles having a size of 1 mm or less to obtain a coarse produce. The obtained coarse product is finely pulverized by a collision air current crusher using a high-pressure gas.

Next, the obtained product finely pulverized is classified by a wind classifier (Elbow-jet, LABO EJ-L3, manufactured by Nittetsu Mining Co., Ltd.) using the Coanda effect to simultaneously remove fine powder and coarse powder. To the obtained particles (100 parts by mass), rutile type titanium oxide (volume average particle diameter: 0.02 μm, treated with n-decyltrimethoxysilane) (0.5 parts by mass) and silica A (prepared by a sol-gel method, volume average particle diameter: 0.11 μm, treated with hexamethyldisilazane) (3.0 parts by mass) are added, mixed by a Henschel mixer (FM-10 type, manufactured by Nippon Coke Engineering Co., Ltd.) at a rotation number of 65 $s^{-1}$ for rotation time of 5 minutes and treated with heat by a surface treatment apparatus shown in FIG. 6 to obtain toner particle 1.

Figure 6:
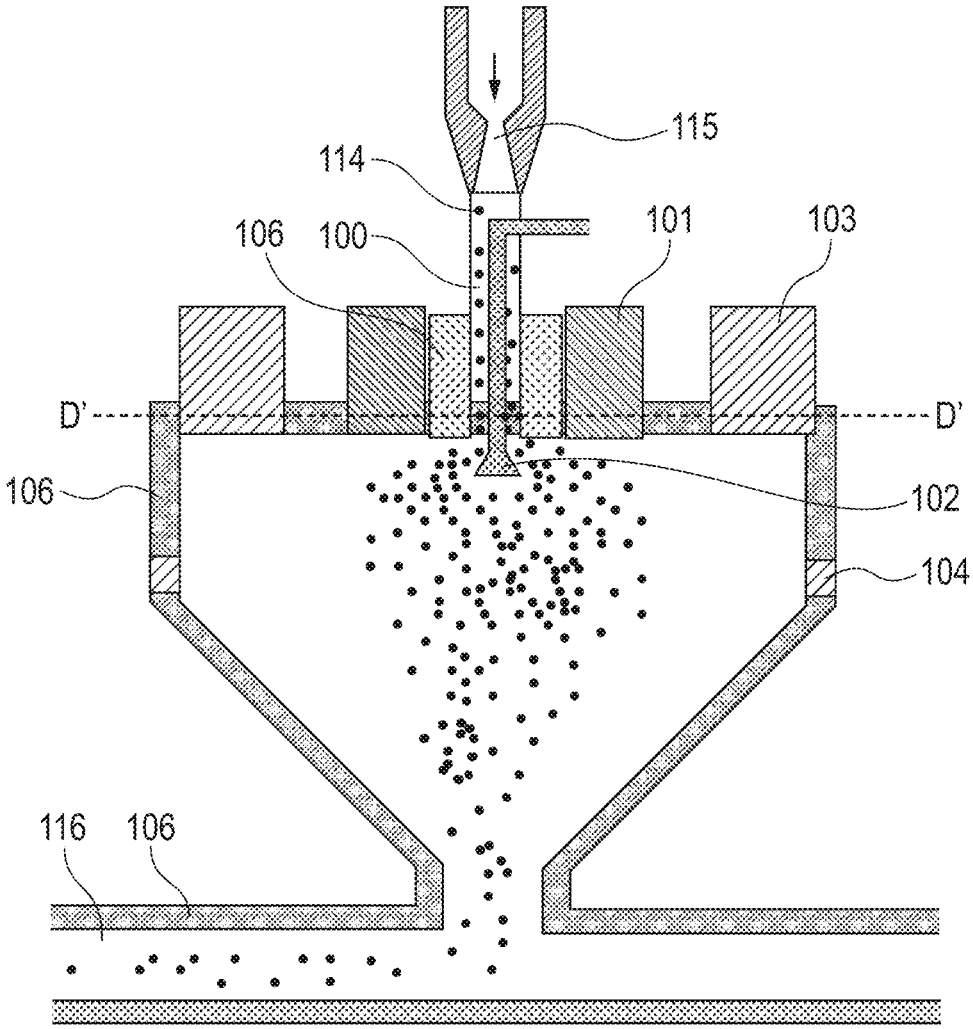
FIG. 6 is a schematic view of an apparatus for treating a surface with hot air, used in Examples of the present invention.

The heat treatment is performed by arranging the lower end of an air spray member 102 at a level lower by 100 mm from a toner supply port 100 in FIG. 6. The surface treatment apparatus shown in FIG. 6 include a hot-air supply port 101, a cool-air supply port 103, a second cool-air supply port 104, a cooling jacket 106, a toner particle 114, a high-pressure air supply nozzle 115 and a transfer piping 116.

Operation conditions are follows: Feed amount=5 kg/hr, hot-air temperature=185° C., hot-air flow rate=6 $m^3$/min, cool-air temperature=5° C., cool-air flow rate=4 $m^3$/min, absolute moisture amount of cool air=3 g/$m^3$, air amount of blower=20 $m^3$/min, injection airflow rate=1 $m^3$/min, diffusion air=0.3 $m^3$/min.

Toner particle 1 obtained has an average circularity of 0.969 and a weight average particle diameter (D4) of 7.2 μm.

Subsequently, to toner particle 1 (100 parts by mass) as mentioned above, rutile type titanium oxide (average particle diameter: 0.02 μm, treated with n-decyltrimethoxysilane) (0.5 parts by mass), silica A (prepared by a sol-gel method, average particle diameter: 0.11 μm, treated with HMDS) (0.5 parts by mass) and silica B (prepared by a vapor phase oxidation method, average particle diameter: 0.04 μm, treated with silicone oil) (1.0 part by mass) are added, mixed by a Henschel mixer (FM-10 type, manufactured by Nippon Coke Engineering Co., Ltd.) at a rotation number of 65 $s^{-1}$ for rotation time of 5 minutes. Thereafter, coarse particles are removed by a sieve having a mesh size of 45 μm to obtain toner 1.

Physical properties of toner 1 are shown in Table 6.

Production Example of Toner 2

To ion exchanged water (500 parts by mass), a 0.12 mole/liter aqueous $Na_3PO_4$ solution (600 parts by mass) is poured. After the mixture is heated to a temperature of 60° C., the mixture is stirred by a TK system homomixer (manufactured by Tokushu Kika Kogyo) at a rate of 11,000 rpm. To the mixture, a 1.2 mole/liter aqueous $CaCl_2$ solution (93 parts by mass) is gradually added to obtain an aqueous medium containing $Ca_3(PO_4)_2$.

| | |
|---|---|
| Styrene | 162.0 parts by mass |
| N-butyl acrylate | 38.0 parts by mass |
| Ester wax (behenyl behenate: melting point 78° C.) | 20.0 parts by mass |
| Aluminum compound of di-tertiary butyl salicylate | 1.0 part by mass |
| Saturated polyester (terephthalic acid-propyleneoxide modified bisphenol A, acid value: 15 mg KOH/g, peak molecular weight: 6000) | 10.0 parts by mass |
| Cyan pigment (Pigment Blue 15:3) | 13.0 parts by mass |

The materials mentioned above are heated to a temperature of 60° C. and homogeneously dissolved and dispersed by use of a TK system homomixer (manufactured by Tokushu Kika Kogyo) at a rate of 10,000 rpm. In this, a polymerization initiator, 2,2'-azobis(2,4-dimethylvaleronitrile) (8 parts by mass) is dissolved to prepare a monomer composition.

To the aqueous medium mentioned above, the above monomer composition is added. The mixture is stirred at a temperature of 60° C. under a nitrogen atmosphere by a TK system homomixer at a rate of 10,000 rpm for 10 minutes to granulate the monomer composition. Thereafter, the granulated product is heated to a temperature of 80° C. while stirring by a paddle stirring vane and reacted for 10 hours. After completion of the polymerization reaction, the remaining monomer is distilled away under reduced pressure. After cooling, hydrochloric acid is added to dissolve $Ca_3(PO_4)_2$—The mixture is filtered, washed with water and dried to obtain toner particle 2.

Subsequently, to the above toner particle 2 (100 parts by mass), i) rutile type titanium oxide (volume average particle diameter: 0.02 μm, treated with n-decyltrimethoxysilane) (1.0 part by mass) ii) silica A (prepared by a sol-gel method, volume average particle diameter: 0.11 μm, treated with hexamethyldisilazane)(2.0 parts by mass), and iii) silica B (prepared by a vapor phase oxidation method, average particle diameter: 0.04 μm, treated with silicone oil) (2.0 parts by mass) are externally added in the same manner as in toner 1 to obtain toner 2.

The physical properties of toner 2 are shown in Table 6.

TABLE 6

| | Weight average particle diameter (D4) | Average circularity |
|---|---|---|
| Toner 1 | 7.1 μm | 0.967 |
| Toner 2 | 6.3 μm | 0.982 |

Example 1

To magnetic carrier 1 (93 parts by mass), toner 1 (7 parts by mass) is added. The mixture is stirred by a V-shape mixer (V-20, manufactured by Seishin Enterprise Co., Ltd.) to obtain a two-component developer as shown in Table 7.

Using a complex machine, modified image RUNNER ADVANCE C5030 manufactured by Cannon Inc. for digital offices as an image forming apparatus, the two-component developer is fed to a developing apparatus which is used for cyan and toner 1 is fed to a supplemental bottle which is used for cyan. An image is formed and evaluated as follows. Note that, the image forming apparatus is modified by reversing the rotation direction of a developer carrying member and applying rectangular AC voltage (a frequency of 8.0 kHz, Vpp of 0.7 kV) and DC voltage $V_{DC}$ to a developer carrying member. In evaluating an image after long-time repeated use, DC voltage $V_{DC}$ of a developer carrying member, charge voltage $V_D$ of an electrostatic latent image carrier and a laser power are controlled to adjust toner consumption to the same level such that the amount of toner for an FFh image (solid image) to be mounted on a paper sheet is 0.50 mg/cm$^2$. FFh refers to 256 gradations represented by hexadecimal notation. 00h represents 1st gradation (a white portion) of the 256 gradations and FFh represents the 256th gradation (a solid portion) of the 256 gradations.

As an output test of an image after long-time repeated use, a solid-image (FFh output) bar chart having an image proportion of 30% is output on 30,000 A4 paper sheets.

The test is performed under the environment of a temperature of 23° C. and humidity 50% RH (hereinafter referred to as "N/N"). As a transfer paper sheet, a paper sheet GF-C081 (81.4 g/m$^2$) for a laser beam printer (manufactured by Cannon Marketing Japan Inc.) was used.

Evaluation is performed based on the following evaluation method. The results are shown in Table 8.

Developing Performance

Developing performance of the initial (first print) printing is evaluated. A solid image (FFh) is formed an electrostatic latent image bearing member. Before the solid image is transferred to an intermediate transfer member, rotation of the electrostatic latent image bearing member is stopped and the toner on the electrostatic latent image bearing member is suctioned and collected by a metal cylindrical tube (Faraday cage) equipped with a cylindrical filter. At this time, the amount of charge Q charged in a condenser through the metal cylindrical tube is measured and image area S is determined from the amount of toner collected. Based on these, the amount of charge per unit area Q/S (mC/kg) is obtained, and then, the amount of charge per unit area Q/S (mC/kg) is divided by contrast potential (Vcont) to obtain Q/S/Vcont ($\mu C \cdot s^3 \cdot A \cdot m^{-4} \cdot kg^{-1}$). Based on this value, developing performance is evaluated. The larger value means more excellent developing performance.

A: 1.20 or more
B: 1.10 or more and less than 1.20
C: 1.00 or more and less than 1.10
D: 0.90 or more and less than 1.00
E: less than 0.90

Leakage (White Spot)

Leakage is evaluated. On five A4 plain paper sheets, a solid (FFh) image is continuously output. White spots of 1 mm or more in diameter are counted in the image formed on five sheets and the total number is calculated. Leakage is evaluated based on the following criteria. Image output in the leakage evaluation differs from normal image output in that rectangular AD voltage (a frequency of 8.0 kHz and Vpp of 1.2 kV) is applied to a developer carrying member.

A: 0 dots
B: 1 dot or more and less than 6 dots
C: 6 dots or more and less than 10 dots
D: 10 dots or more and less than 20 dots
E: 20 dots or more Q/M Retention Rate Q/M on an electrostatic latent image bearing member before and after long-time repeated use is evaluated. On the electrostatic latent image bearing member, a solid image (FFh) is formed. Before the solid image is transferred to an intermediate transfer member, rotation of the electrostatic latent image bearing member is stopped and the toner on the electrostatic latent image bearing member is suctioned and collected by a metal cylindrical tube (Faraday cage) equipped with a cylindrical filter. At this time, the amount of charge Q charged in a condenser through the metal cylindrical tube is measured and the mass M of the toner collected is measured. The amount of charge per unit mass Q/M (mC/kg) is calculated to obtain a value of Q/M (mC/kg) on the electrostatic latent image bearing member.

Assuming that the absolute value of Q/M on the initial electrostatic latent image bearing member is regarded as 100%, the absolute value of Q/M on the electrostatic latent image bearing member after long-time repeated use is calculated and then a retention rate of Q/M absolute value is obtained. Evaluated is made based on the following criteria.

$$\text{Retention rate (\%)} = |Q/M \text{ after long-time repeated use}| / |\text{initial } Q/M| \times 100$$

A: Q/M retention rate on electrostatic latent image bearing member is 90% or more
B: Q/M retention rate on electrostatic latent image bearing member is 80% or more and less than 90%
C: Q/M retention rate on electrostatic latent image bearing member is 70% or more and less than 80%

D: Q/M retention rate on electrostatic latent image bearing member is 60% or more and less than 70%

E: Q/M retention rate on electrostatic latent image bearing member is less than 60%

Dot Reproducibility

A half-tone image (30h image) is output and reproducibility of dots in the image is evaluated by visual observation based on the following criteria. Note that the "30h" of the image is a value representing a half-tone image when 256 gradation is expressed by hexadecimal numeral in which 00h represents solid white and FFh represents solid black.

A: Roughness is not sensed and the image is smooth.

B: Roughness is not virtually sensed.

C: Roughness is slightly sensed but practically has no problem.

D: Roughness is sensed.

E: Roughness is significantly sensed.

Adhesion of Carrier to Solid Black

Adhesion of a carrier to a solid black portion is evaluated as follows. After an image is output on 30,000 paper sheets, each evaluation is performed. Thereafter, the evaluation machine is allowed to stand still at a high-temperature and high-humidity environment (30° C./80% RH) for days, and then a solid black chart is output under environment of 30° C./80% RH and visually observed. A solid (FFh) image is continuously output on five A4 plain paper sheets, evaluation is performed based on the degree of non-uniformity like "fog".

A: No "fog" is sensed and the image is smooth.

B: In one of the five paper sheets or partly in each paper sheet, non-uniformity is sensed.

C: Non-uniformity is sensed partly in each paper sheet but virtually no problem.

D: Non-uniformity is sensed.

E: Non-uniformity is wholly sensed.

Examples 2 to 8, Comparative Examples 1 to 4

As shown in Table 6, a toner and a magnetic carrier are mixed in predetermined amounts and evaluation is performed in the same manner as in Example 1. Evaluation results are shown in Table 7.

In Comparative Example 1, a spherical magnetic substance small in size is used. The surface of the carrier core has no projections ascribed to a magnetic substance. As a result, developing performance is poor, toner spent occurs and long-term stability is poor.

In Comparative Example 2, an irregular shape magnetic substance is used; however, the particle diameter is small, with the result that the present ratio on a carrier core surface is low and leakage significantly occurs.

In Comparative Example 3, since a magnetic substance containing no zinc is used, residual magnetization is large, with the result that a carrier adheres to a solid portion of an image output after long-time repeated use and thus uniformity of solid-image quality is low.

In Comparative Example 4, a magnetic substance having a large average particle diameter is used. Therefore, the amount of the magnetic substance in a magnetic carrier is low and resistance increases. As a result, the developing performance after long-time repeated use is poor.

TABLE 7

| | Toner | Magnetic carrier | Toner Density (mass %) |
|---|---|---|---|
| Example 1 | Toner 1 | Magnetic carrier 1 | 7 |
| Example 2 | Toner 1 | Magnetic carrier 2 | 7 |
| Example 3 | Toner 1 | Magnetic carrier 3 | 7 |
| Example 4 | Toner 1 | Magnetic carrier 4 | 7 |
| Example 5 | Toner 1 | Magnetic carrier 5 | 7 |
| Example 6 | Toner 1 | Magnetic carrier 6 | 7 |
| Example 7 | Toner 1 | Magnetic carrier 7 | 7 |
| Example 8 | Toner 2 | Magnetic carrier 1 | 8 |
| Comparative Example 1 | Toner 1 | Magnetic carrier 8 | 7 |
| Comparative Example 2 | Toner 1 | Magnetic carrier 9 | 7 |
| Comparative Example 3 | Toner 1 | Magnetic carrier 10 | 7 |
| Comparative Example 4 | Toner 1 | Magnetic carrier 11 | 7 |

TABLE 8

| | | | Developing performance | | Leakage | | Q/M Retention rate | | | HT image quality | | Carrier adhesion onto solid image (solid-image quality) |
|---|---|---|---|---|---|---|---|---|---|---|---|---|
| | Toner | Magnetic carrier | Initial | After 30000 prints | Initial | After 30000 prints | Initial (−mC/kg) | After 30000 prints (−mC/kg) | Retention rate (%) | Initial | After 30000 prints | After 30000 prints 30° C./80% RH |
| Example 1 | Toner 1 | Magnetic carrier 1 | A (1.23) | A (1.21) | A (0) | B (1) | 40 | 37 | A (93) | A | A | A |
| Example 2 | Toner 1 | Magnetic carrier 2 | A (1.24) | A (1.22) | A (0) | A (0) | 42 | 40 | A (95) | A | A | A |
| Example 3 | Toner 1 | Magnetic carrier 3 | A (1.24) | B (1.18) | B (2) | B (3) | 38 | 33 | B (87) | A | C | B |
| Example 4 | Toner 1 | Magnetic carrier 4 | B (1.17) | B (1.15) | A (0) | A (0) | 42 | 37 | B (88) | A | A | A |
| Example 5 | Toner 1 | Magnetic carrier 5 | A (1.22) | A (1.21) | B (3) | B (4) | 40 | 34 | B (85) | A | B | B |
| Example 6 | Toner 1 | Magnetic carrier 6 | A (1.21) | B (1.18) | A (0) | B (1) | 39 | 34 | B (87) | A | A | B |

TABLE 8-continued

| | | | Developing performance | | Leakage | | Q/M Retention rate | | | HT image quality | | Carrier adhesion onto solid image (solid-image quality) |
|---|---|---|---|---|---|---|---|---|---|---|---|---|
| | Toner | Magnetic carrier | Initial | After 30000 prints | Initial | After 30000 prints | Initial (−mC/kg) | After 30000 prints (−mC/kg) | Retention rate (%) | Initial | After 30000 prints | After 30000 prints 30° C./80% RH |
| Example 7 | Toner 1 | Magnetic carrier 7 | A (1.20) | B (1.17) | A (0) | B (5) | 40 | 31 | C (78) | A | B | C |
| Example 8 | Toner 2 | Magnetic carrier 1 | A (1.26) | B (1.24) | A (0) | B (2) | 43 | 38 | B (88) | A | B | A |
| Comparative Example 1 | Toner 1 | Magnetic carrier 8 | D (0.93) | E (0.85) | A (0) | A (0) | 44 | 30 | D (68) | A | B | A |
| Comparative Example 2 | Toner 1 | Magnetic carrier 9 | A (1.22) | B (1.15) | C (6) | D (18) | 40 | 33 | B (83) | B | D | C |
| Comparative Example 3 | Toner 1 | Magnetic carrier 10 | B (1.17) | B (1.10) | A (0) | C (6) | 39 | 30 | C (77) | B | C | E |
| Comparative Example 4 | Toner 1 | Magnetic carrier 11 | C (1.03) | D (0.97) | B (2) | B (4) | 37 | 32 | B (86) | A | B | C |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-175724, filed Aug. 8, 2012, which is hereby incorporated by reference herein in its entirety.

What is claimed is:

1. A magnetic carrier comprising:

a magnetic substance-dispersed resin carrier core, which contains a magnetic substance and a binding resin, and a coating resin on a surface thereof, wherein:

the magnetic substance-dispersed resin carrier core has a resistivity Rk at 1000 V/cm of $5.0\times10^6$ Ω·cm or more and $8.0\times10^7$ Ω·cm or less, the magnetic substance i) has a number average particle diameter of 0.20 μm or more and 0.35 μm or less, and ii) comprises magnetic-substance particles having a shape with vertexes and having a particle diameter of 0.53 μm or more in an amount of 10.0 vol % or more and 32.0 vol % or less based on a total amount of the magnetic substance;

and wherein:

when analyzing an element in the magnetic substance-dispersed resin carrier core by a fluorescent X-ray analysis and calculating the contents of Fe element and Zn element therein by fundamental parameter quantitative method, i) an $Fe_2O_3$ content is 98.00% by mass or more, and ii) a ZnO content is 0.06% by mass or more and 0.50% by mass or less, with respect to the total amount by mass of all the detected elements provided that all the detected elements are in oxide form.

2. The magnetic carrier according to claim 1, wherein the magnetic carrier has a magnetization intensity at 79.6 kA/m of 50.0 $Am^2/kg$ or more and 60.0 $Am^2/kg$ or less and has a residual magnetization of 8.5 $Am^2/kg$ or less.

3. The magnetic carrier according to claim 1, wherein, resistivity of the magnetic carrier at 1000 V/cm represented by Rc and the resistivity Rk satisfy $$0.8 \leq Rc/Rk \leq 70.0.$$

4. The magnetic carrier according to claim 3, wherein the resistivity Rc is $5.0\times10^6$ Ω·cm or more and $8.0\times10^7$ Ω·cm or less.

5. The magnetic carrier according to claim 1, wherein, within a range from the surface of the magnetic substance-dispersed resin carrier core to a depth of 1.0 μm, an area proportion of the binding resin portion is 35% or more and 80% or less with respect to a sum of an area of a binding resin portion and a sectional area of a magnetic substance portion.

6. The magnetic carrier according to claim 1, wherein, in the surface of the magnetic substance-dispersed resin carrier, convex portions of the magnetic-substance particles having the shape with vertexes are present at a density of 0.8 portions/$\mu m^2$ or more and 3.0 portions/$\mu m^2$ or less.

7. The magnetic carrier according to claim 1, wherein the magnetic carrier has a 50% particle diameter (D50) on a volume distribution basis of 20.0 μm or more and 70.0 μm or less.

8. The magnetic carrier according to claim 1, wherein the magnetic carrier has a true specific gravity of 3.0 $g/cm^3$ or more and 4.0 $g/cm^3$ or less.

9. A two-component developer comprising a toner and the magnetic carrier according to claim 1.

10. The two-component developer according to claim 9, wherein the toner has an average circularity of 0.945 or more and 0.985 or less.

* * * * *